US007199768B2

(12) United States Patent
Ono et al.

(10) Patent No.: US 7,199,768 B2
(45) Date of Patent: Apr. 3, 2007

(54) DISPLAY APPARATUS CONTROLLING BRIGHTNESS OF CURRENT-CONTROLLED LIGHT EMITTING ELEMENT

(75) Inventors: Shinya Ono, Siga (JP); Yoshinao Kobayashi, Siga (JP)

(73) Assignees: Kyocera Corporation, Kyoto-Shi (JP); Chi Mei Optoelectronics Corp. (TW)

( * ) Notice: Subject to any disclaimer, the term of this patent is extended or adjusted under 35 U.S.C. 154(b) by 516 days.

(21) Appl. No.: 10/782,861

(22) Filed: Feb. 23, 2004

(65) Prior Publication Data

US 2004/0174354 A1 Sep. 9, 2004

(30) Foreign Application Priority Data

Feb. 24, 2003 (JP) ..... 2003-046541
Nov. 21, 2003 (JP) ..... 2003-392777

(51) Int. Cl.
*G09G 3/36* (2006.01)

(52) U.S. Cl. ..... 345/76; 345/77

(58) Field of Classification Search ..... 257/753, 257/762; 315/169.1, 169.3; 345/76, 77, 345/80, 81–84; 349/43–46
See application file for complete search history.

(56) References Cited

U.S. PATENT DOCUMENTS 6,583,775 B1 * 6/2003 Sekiya et al. ..... 345/76
6,583,776 B2 * 6/2003 Yamazaki et al. ..... 345/77
6,859,193 B1 * 2/2005 Yumoto ..... 345/82
6,970,149 B2 * 11/2005 Chung et al. ..... 345/82
2004/0252089 A1 * 12/2004 Ono et al. ..... 345/82

FOREIGN PATENT DOCUMENTS

JP 8-234683 A 9/1996

* cited by examiner

*Primary Examiner*—Nitin Patel
(74) *Attorney, Agent, or Firm*—Birch, Stewart, Kolasch & Birch, LLP

(57) ABSTRACT

A display apparatus according to the present invention is equipped with a data writing section that includes a data line which supplies electric potential and a first switching section that controls writing of electric potential supplied, and a threshold voltage detecting section that includes a second switching section which controls conduction between a gate electrode and a drain electrode of the driver element and a current light emitting element which is a capacitor that supplies electric charge to the driver element.

19 Claims, 23 Drawing Sheets

DISPLAY APPARATUS CONTROLLING BRIGHTNESS OF CURRENT-CONTROLLED LIGHT EMITTING ELEMENT

BACKGROUND OF THE INVENTION

1) Field of the Invention

The present invention relates to a display apparatus in which brightness of a current-controlled light emitting element is controlled.

2) Description of the Related Art

An organic EL display apparatus in which an organic electroluminescence (EL) element (Organic Light Emitting Diode) is used, has been sought to be used practically as the next generation display apparatus because it is suitable for thinning of the apparatus as it does not require a back light, which is necessary in a liquid crystal display apparatus and there is no limitation on an angle of visibility. Moreover, the organic EL element that is Used in the organic EL display apparatus differs from the liquid crystal display which controls a liquid crystal cell by the voltage in that brightness of each light emitting element is controlled by the current flowing therethrough.

In the organic EL display apparatus, a simple (passive) matrix type and an active matrix type can be adopted as a driving system. The former, though has a simple structure, has a problem of difficulty in realization of a big-size and a highly defined display. For this, in recent years, a development of active matrix type in which a current flowing through a light emitting element inside a pixel, controls an active element that is provided in the pixel at the same time, for example a thin film transistor (TFT), has been carried out actively.

FIG. 20 is a pixel circuit in an organic EL display apparatus of the active matrix type according to a conventional technology. The pixel circuit in the conventional technology, has a structure that includes an organic EL element 105 in which a cathode side is connected to a positive power supply $V_{dd}$, a TFT 104 in which a drain electrode is connected to an anode side of the organic EL element 105 and a source electrode is connected to ground, a capacitor 103 that is connected between a gate electrode of the TFT 104 and ground, and a TFT 102 in which a drain electrode in connected to the gate electrode of the TFT 104, a source electrode is connected to a data line 101, and a gate electrode is connected to a scan line 106.

An operation of the pixel circuit mentioned above is described below. When an electric potential of the scan line is allowed to be of a high level and a writing electric potential is applied to the data line 101, the TFT 102 is put ON, the capacitor 103 is either recharged or discharged, and a gate electrode potential of the TFT 104 becomes the writing electric potential. Further, when an electric potential of the scan line 106 is allowed to be of a low level, the TFT 102 is put OFF and the scan line 106 and the TFT 102 are disconnected electrically, however a gate electrode potential of the TFT 104 is maintained to be constant by the capacitor 103.

Then, a current flowing through the TFT 104 and the organic EL element 105 is a value in accordance with a voltage $V_{gs}$ between the gate and the source of the TFT 104 and the organic EL element 105 continues to emit light having brightness in accordance with this current. Here, the operation of conveying brightness information that is supplied to the data line 101 upon selecting the scan line 106, to an inside of a pixel is called as writing from here onward. As mentioned above, in the pixel circuit shown in FIG. 20, once a potential is written, the organic EL element 105 continues to emit light having a constant brightness (for example, refer to Japanese Patent Application Laid-open Publication No. H8-234683). Here, in the active matrix type organic EL element display apparatus, a TFT formed on a glass substrate is used as an active element.

However, in a TFT that is formed by using amorphous silicon, when current has flown for a long time, there is a problem that a threshold voltage fluctuates from a voltage during the time when the current was flowing. Moreover, there is a problem of a fluctuation in the threshold voltage due to deterioration of the TFT. Thus, the TFT that is formed by using amorphous silicon may cause fluctuation of the threshold voltage in the same pixel.

FIG. 21 is a graph that shows voltage-current characteristics of a TFT before deterioration and a TFT after deterioration. In FIG. 21, a curve $l_3$ indicates characteristics of voltage $V_{gs}$ between a gate and a source of the TFT before deterioration and drain current $I_d$, and a curve $\mathbf{1}_4$ indicates characteristics of the TFT after deterioration. Moreover, $V_{th4}$ and $V_{th4}'$ are threshold voltages of the TFT before deterioration and after deterioration. As shown in FIG. 21, since the threshold voltages of the TFT before deterioration and after deterioration differ, when the same electric potential $V_{D4}$ is written, drain currents $I_{d2}$ and $I_{d3}$ for each have different values. Therefore, by applying the electric potential $V_{D4}$, in spite of the fact that only $I_{d2}$ has flown in the organic EL element before the deterioration of the TFT which is the driver element, no current except $I_{d3}$ ($<I_{d2}$) flows after the deterioration of the TFT and light of a predetermined brightness cannot be displayed. Due to this, when a threshold voltage of a TFT that controls current flowing through a current-controlled light emitting element (hereinafter, "current light emitting element") fluctuates, in spite of the fact that the same electric potential is applied, the current flowing through the current light emitting element fluctuates and as a result, brightness that is displayed on a display section of a display apparatus becomes non-uniform thereby causing the deterioration of the image quality.

SUMMARY OF THE INVENTION

It is an object of the present invention to at least solve the problems in the conventional technology.

A display apparatus according to the present invention includes a data writing section that includes a data line and a first switching section which controls writing of electric potential that is supplied through the data line, and writes an electric potential corresponding to an emission brightness; and a threshold voltage detecting section that includes a driver transistor which controls current according to the electric potential written by the data writing section; a second switching section which controls conduction between a gate electrode and a drain electrode of the driver transistor; and a current-controlled light emitting element that emits light with a brightness corresponding to a current flowing therethrough, and of functions as a capacitor for supplying electric charge to the drain electrode or a source electrode of the driver transistor, wherein the threshold voltage detecting section detects a threshold voltage of the driver transistor.

The other objects, features, and advantages of the present invention are specifically set forth in or will become apparent from the following detailed descriptions of the invention when read in conjunction with the accompanying drawings.

DETAILED DESCRIPTION

Figure 1:
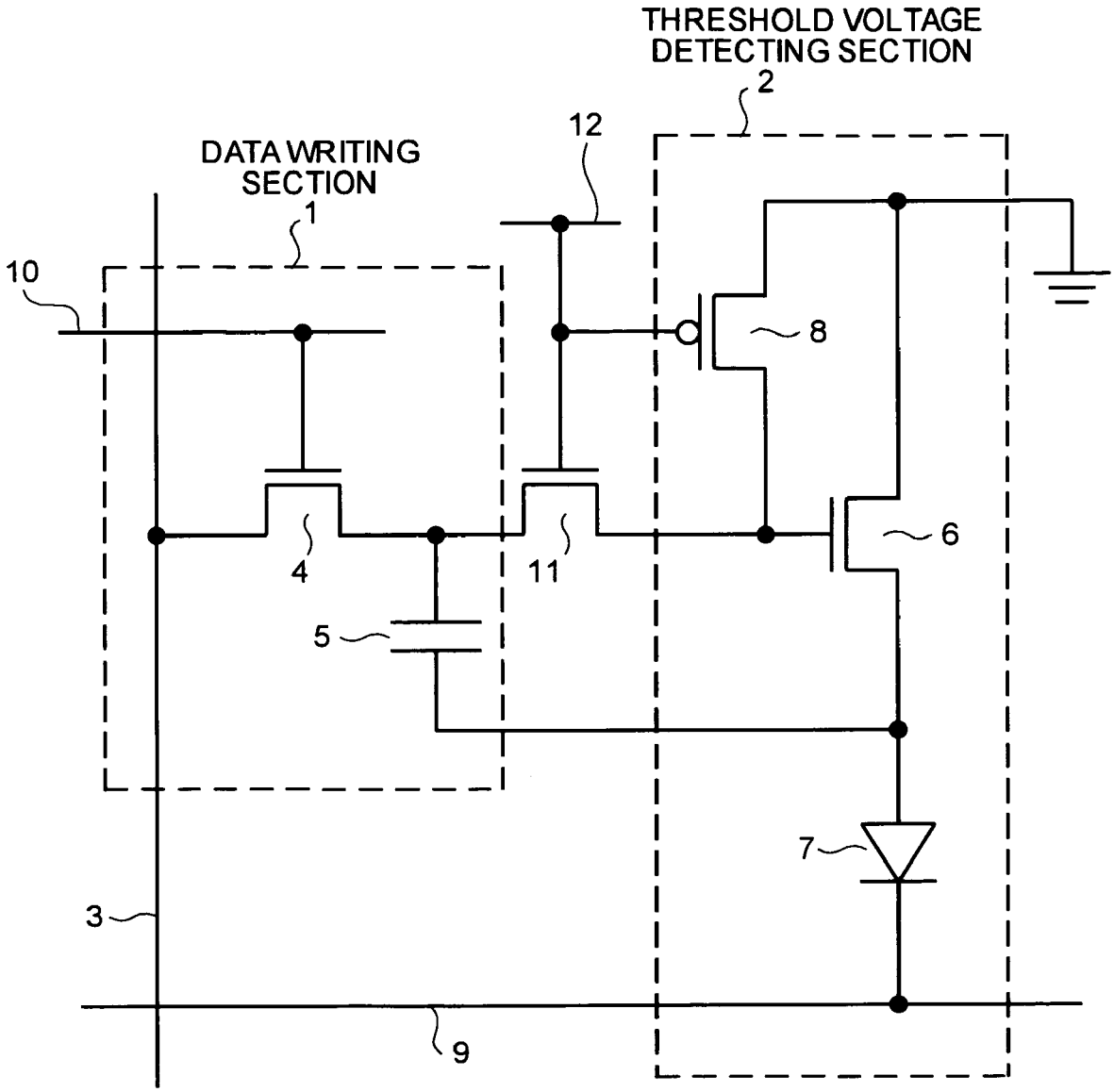
FIG. 1 is a diagram in which a structure of a pixel circuit in a first embodiment is shown.

A display apparatus according to the present invention is described below by referring to diagrams. Here, with regard to the present invention, although cases in which an organic EL element is used as a current light emitting element, a thin film transistor is used as an active element in an active matrix type display apparatus and a liquid crystal display apparatus respectively are described, it (the present invention) is also applicable to any of the active matrix type display apparatus that uses current light emitting element in which brightness changes according to the current flowing, as a display element of a pixel. Moreover, this invention is not limited to these embodiments. Furthermore, as for diagrams, same reference numerals are used for identical components and the diagrams are schematic representations.

First of all, a display apparatus according to a first embodiment is described. A pixel circuit in the display apparatus according to the first embodiment includes a data writing section that has a data line, a first switching section, and a capacitor and writes an electric potential corresponding to a brightness of light emitted and a threshold voltage detecting section that has a second switching section and a current light emitting element, and detects a threshold voltage of a driver element. Moreover, the pixel circuit in the display apparatus according to the first embodiment has a structure that includes a TFT as a switching section that controls electrical connections of the data writing section and the threshold voltage detecting section. According to the pixel circuit, the data writing section and the threshold voltage detecting section are built to operate independently and by applying to the driver element an electric potential in which a threshold voltage that is detected by the threshold voltage detecting section which can operate independently from the data writing section, is added to an electric potential that is written by the data writing section, a display apparatus that supplies a uniform current to the current light emitting element even when the threshold voltage of the driver element fluctuates, can be realized.

FIG. 1 is a diagram in which a structure of the pixel circuit in the first embodiment is shown. The pixel circuit, as shown in FIG. 1, has a data writing section 1 that includes a data line 3 that supplies an electric potential corresponding to brightness of the current light emitting element, a TFT 4 which is a first switching section that controls the writing of the electric potential, a capacitor 5 that holds the electric potential that is written, and a scan line 10 which is a first scan line that is connected to a gate electrode of the TFT 4. The data writing section 1 functions as an example of a data writing section in claims. The data line 3 functions as an example of a data line in the claims. The TFT 4 functions as an example of a first switching section in the claims. The scan line 10 functions as an example of a first scan line in the claims. Further, the capacitor 5 has a function of holding an electric potential that is supplied from the data line 3.

Moreover, the pixel circuit in the first embodiment has a threshold voltage detecting section 2 that includes a TFT 6 which is a driver element that controls current according to the electric potential written by the data writing section 1, a TFT 8 that is a second switching section, an organic EL element 7 which is a current light emitting element, and a common line 9 which is a power-supply line that is connected to the organic EL element 7. The threshold voltage detecting section 2 functions as an example of a threshold voltage detecting section in the claims. The TFT 6 functions as an example of a driver element in the claims and has a function of controlling current according to the electric potential that is written by the data writing section 1. The TFT 8 functions as an example of a second switching section in the claims. The organic EL element 7 functions as an example of current light emitting element in the claims. And the common line 9 functions as an example of a power-supply line in the claims.

Moreover, a TFT 11 which is a third switching section is provided between the data writing section 1 and the threshold voltage detecting section 2. The TFT 11 functions as an example of a third switching section in the claims. The display apparatus according to the first embodiment is formed by disposing the pixel circuit in the form of a matrix. Furthermore, to facilitate the description, regarding the TFT 6, an electrode that is connected to the organic EL element 7 is let to be a source electrode and an electrode that is connected to ground is let to be a drain electrode.

An electric potential corresponding to a display brightness of the organic EL element 7 is applied by the data line 3 to the data writing section 1 and the data writing section 1 has a function of holding the potential that is applied. The data line 3 in the data writing section 1 applies an electric potential corresponding to a brightness of light emitted by the organic EL element 7 and the TFT 4 is connected to the data line 3 and performs control of writing of an electric potential that is supplied through the data line 3. Moreover, the capacitor 5 is connected to a drain electrode of the TFT 4 and maintains the electric potential that is written and supplies the electric potential that is maintained in a gate electrode of the TFT 6. Furthermore, the scan line 10 is connected to the gate electrode of the TFT 4 and controls ON or OFF drive of the TFT 4.

The threshold voltage detecting section 2 has a function of detecting a threshold voltage of the TFT 6 which is a driver element. When the TFT 6 in the threshold voltage detecting section 2 is put ON, it supplies a current corresponding to a voltage between the gate and the source to the organic EL element 7. Although the organic EL element 7 is primarily for displaying light of a brightness corresponding to a current that is applied when the TFT 6 is ON, in the threshold voltage detecting section 2, it functions as a capacitor that supplies electric charge to the source electrode of the TFT 6. The organic EL element 7 can be regarded electrically as an equivalent of a light emitting diode since when an electric potential difference in a forward direction is applied, current flows and light is emitted, whereas when an electric potential difference in a reverse direction is applied, it has a function of storing electric charge according to the difference in electric potential.

Moreover, in the TFT 8 in the threshold voltage detecting section 2, a source electrode is connected to the gate electrode of the TFT 6 and a drain electrode is connected to the drain electrode of the TFT 6. Furthermore, the drain electrode of the TFT 6 and the drain electrode of the TFT 8 are connected to ground. Therefore, when the TFT 8 is ON, it has a function of short-circuiting the gate electrode and the drain electrode of the TFT 6 as well as connecting the gate electrode of the TFT 6 to ground. As mentioned in the latter part, in the display apparatus according to the first embodiment, by providing the TFT 8 etc., detection of threshold voltage of the TFT 6 is made possible without using components like the data line 3 of the data writing section 1. Moreover, ON state of the TFT 8 is controlled by a scan line 12. The scan line 12 functions as an example of a second scan line in the claims. Further, although the common line 9 is primarily for supplying current during emission of light from the organic EL element 7, in the threshold voltage detecting section 2, also has a function of making a current flow to the TFT 6 from the source electrode to the drain electrode by inverting polarity of electric potential as compared to that during emission and allowing storing of electric charge in the organic EL element 7.

Moreover, the TFT 11 is provided between the data writing section 1 and the threshold voltage detecting section 2 and controls an electric conduction of the data writing section 1 and the threshold voltage detecting section 2. In other words, TFT 11 is put ON to allow electric conduction between the data writing section 1 and the threshold voltage detecting section 2 and to generate a predetermined electric potential difference between the gate electrode and the source electrode of the TFT 6, and the TFT 11 is put OFF to isolate electrically the data writing section 1 and the threshold voltage detecting section 2. By providing the TFT 11, since it is possible to isolate electrically the data writing section 1 and the threshold voltage detecting section 2, effect of an operation on one side on an operation of the other side is prevented.

Moreover, the TFT 11 is a TFT that has different conductivity type of channel layer than that of the TFT 8 in the threshold voltage detecting section 2. Furthermore, both of a gate electrode of the TFT 11 and a gate electrode of the TFT 8 are connected to the scan line 12 and according to the polarity of the electric potential that is supplied to the scan line 12, any one of the TFT 8 and the TFT 11 is put ON. For example, if the TFT 8 is a p-type TFT as shown in FIG. 1, then the TFT 11 is an n-type TFT that has different conductivity type of channel layer than that of the TFT 8. To put the TFT 11 ON, it is necessary to make electric potential of the scan line 12 positive potential and to put the TFT 8 ON, it is necessary to make electric potential of the scan line 12 negative potential. Moreover, the TFT 11 may be let to be a p-type TFT and the TFT 8 may be let to be an n-type TFT and in this case, to put the TFT 11 ON, it is necessary to make electric potential of the scan line 12 negative potential and to put the TFT 8 ON it is necessary to make electric potential of the scan line 12 positive potential. As mentioned in the latter part, the TFT 8 which is the second switching section and the TFT 11 which is the third switching section may by allowed to be TFTs which have the same conductivity type of channel layer and in such a case, the TFT which is the second switching section and the TFT which is the third switching section are to be controlled by different scan lines.

Figure 2:
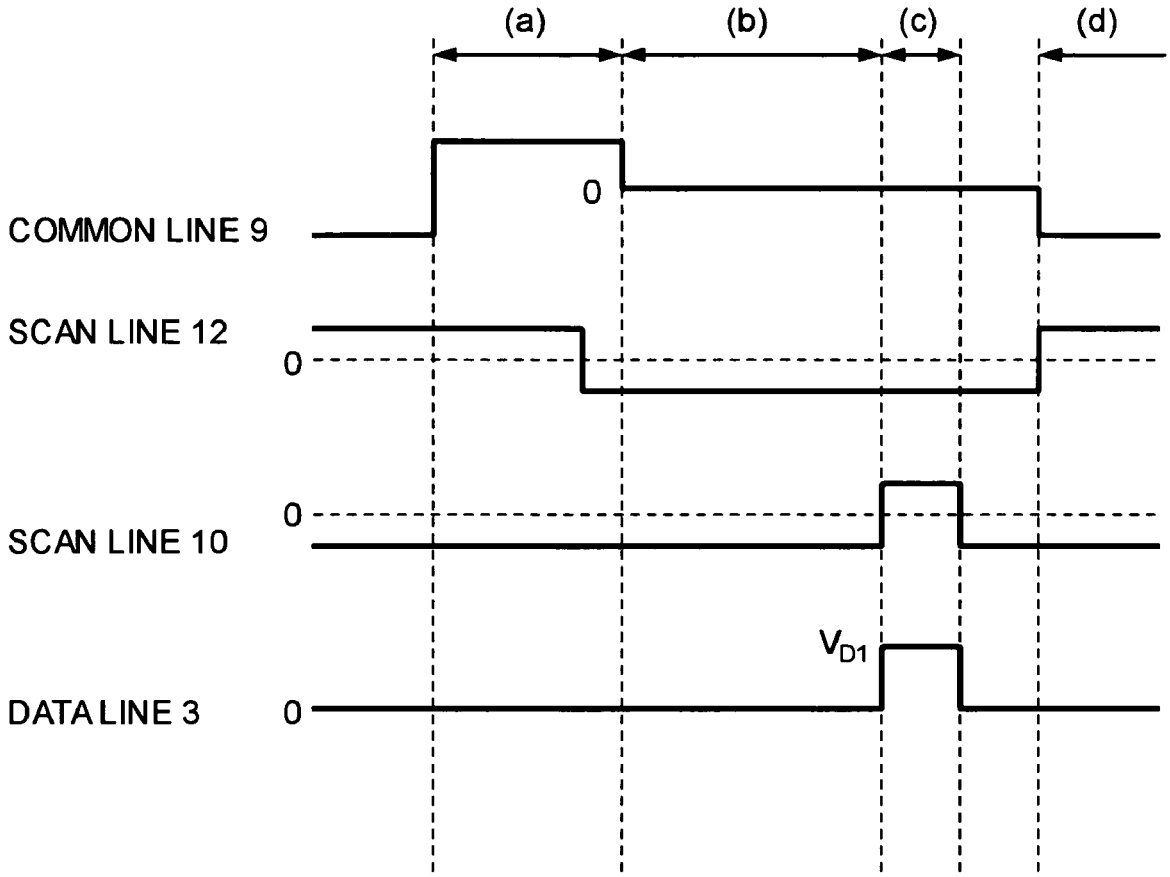
FIG. 2 is a timing chart of the pixel circuit shown in FIG. 1.
Figure 3A:
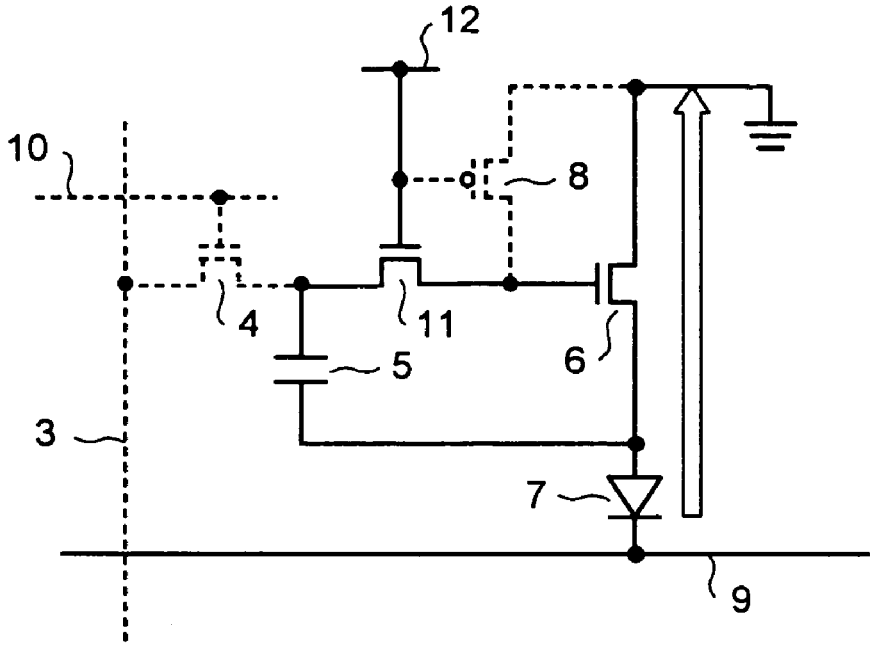
FIG. 3A is a diagram that shows a step of an operating method of the pixel circuit in (a) shown in FIG. 2.

Further, an operation of the pixel circuit shown in FIG. 1 is described by referring to FIG. 2 and FIG. 3A to FIG. 3D. FIG. 2 is a timing chart of the pixel circuit according to the first embodiment. FIG. 3A is a diagram that shows a step of an operating method of the pixel circuit in (a) shown in FIG.

Figure 3B:
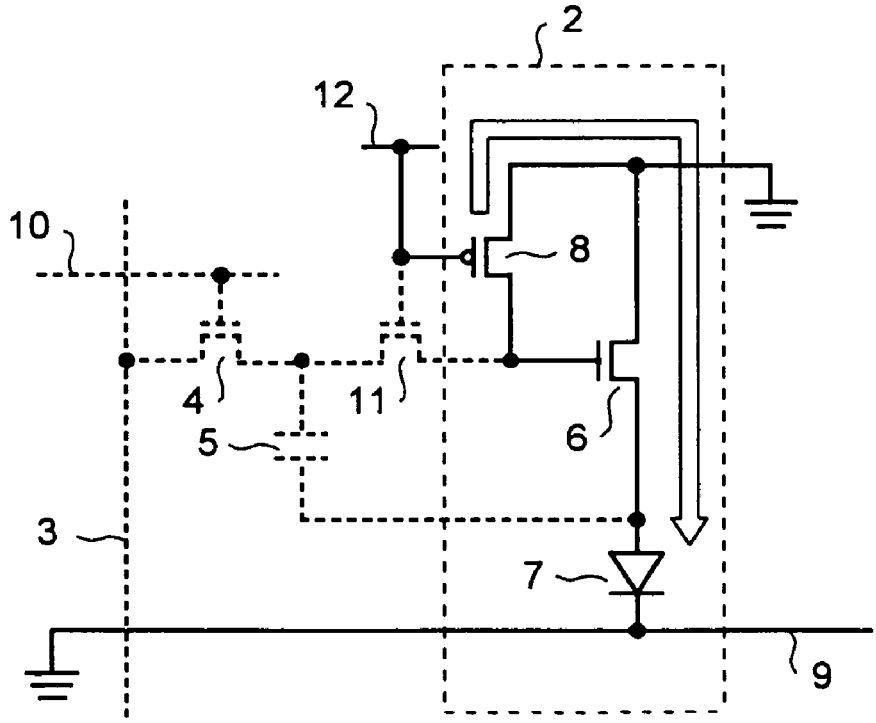
FIG. 3B is a diagram that shows a step of an operating method of the pixel circuit in (b) shown in FIG. 2.
Figure 3C:
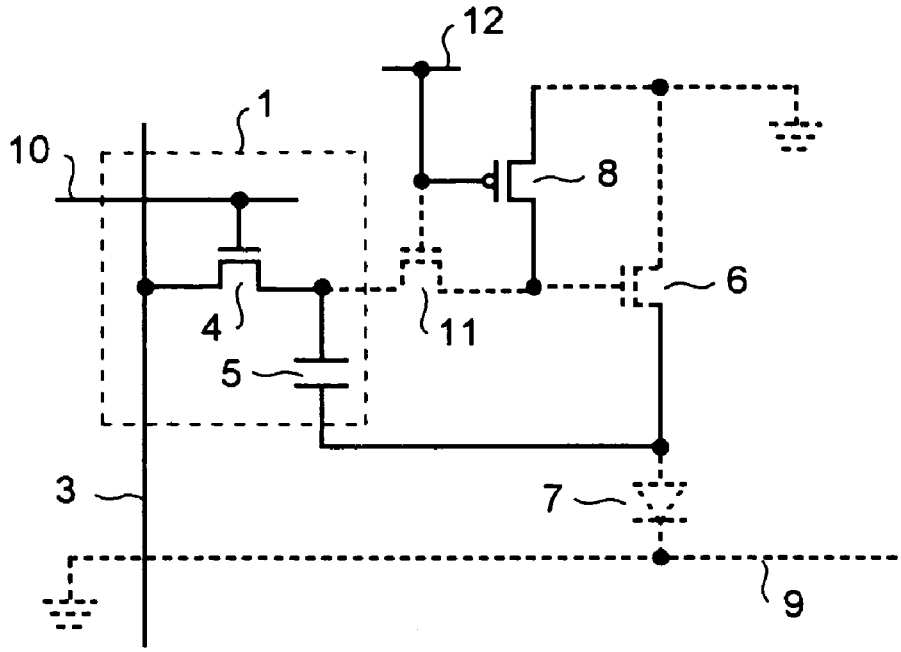
FIG. 3C is a diagram that shows a step of an operating method of the pixel circuit in (c) shown in FIG. 2.
Figure 3D:
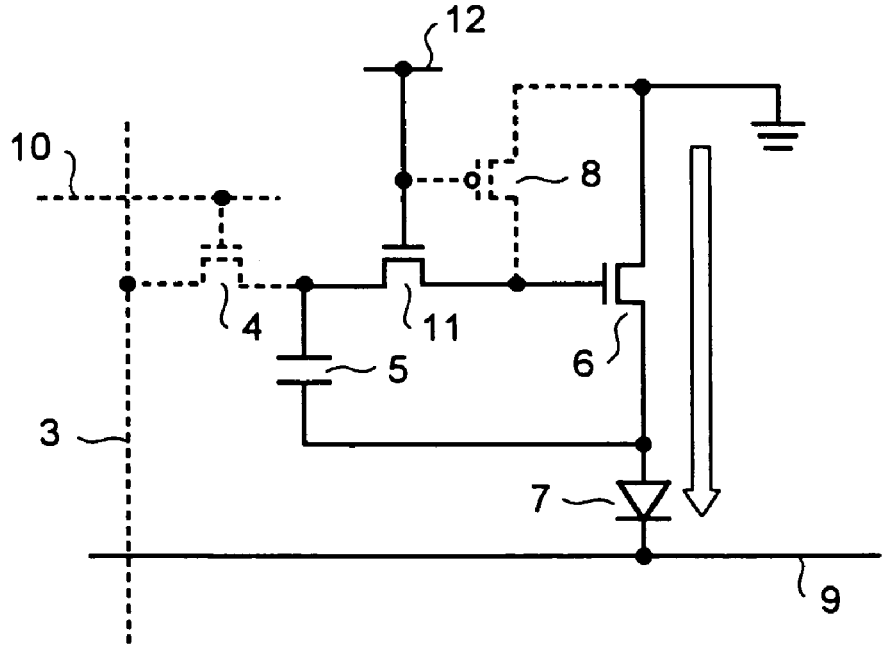
FIG. 3D is a diagram that shows a step of an operating method of the pixel circuit in (d) shown in FIG. 2.

2, FIG. 3B is a diagram that shows a step of an operating method of the pixel circuit in (b) shown in FIG. 2, FIG. 3C is a diagram that shows a step of an operating method of the pixel circuit in (c) shown in FIG. 2, and FIG. 3D is a diagram that shows a step of an operating method of the pixel circuit in (d) shown in FIG. 2. In the display apparatus according to the first embodiment, as shown in (a) to (d) in FIG. 2 and FIG. 3A to FIG. 3D, the data writing and the threshold voltage detection in the pixel circuit is performed by independent steps. Further, in FIG. 3A to FIG. 3D, solid lines indicate portions through which current flows and dashed lines indicate portions through which no current flows.

A step shown in FIG. 2(*a*) and FIG. 3A is a pre-processing step of storing electric charge in the organic EL element 7 as a previous step of the threshold voltage detection. Concretely, it is a step of allowing a current flow in the TFT 6 in a direction opposite to that during the emission of light and storing electric charge in the organic EL element 7. Here, due to the current flow in the TFT 6 in the direction opposite to that during the emission of light, i.e. current flowing from the source electrode to the drain electrode, a positive electric potential greater than that on the drain electrode is required to be applied to the source electrode of the TFT 6. For this, a polarity of an electric potential of the common line 9 to which the source electrode of the TFT 6 is connected, becomes a positive electric potential from a negative electric potential. Moreover, the TFT 11 continues to be ON and to continue the supply of electric charge from the capacitor 5 to the gate electrode of the TFT 6, the TFT 6 continues to be ON. Therefore, the source electrode of the TFT 6 generates an electric potential difference greater than that of the drain electrode, an electric potential greater than the threshold voltage is applied to the gate electrode with respect to the drain electrode, and the current flows through the TFT 6 from the source electrode to the drain electrode. Since the current flows through the direction opposite to that during the emission of light in the organic EL element 7 that is connected to the TFT 6, the organic EL element 7 functions as a capacitor and the negative electric charge which is sufficiently greater than an electric charge that is remained in the capacitor 5 is stored in the anode side. After the electric charge is stored in the organic EL element 7, to hold the stored electric charge, an electric potential of the scan line 12 is inverted by making it negative electric potential and the TFT 11 is put OFF. At this time, The TFT 8 which is controlled by the scan line similar to the TFT 11 is put ON. At this step, since the data writing is not performed, it is necessary to put ON the TFT 4 which controls writing of an electric potential from the data line 3 and the scan line 10 is with a negative electric potential as it is.

A step shown in FIG. 2(*b*) and FIG. 3B is a threshold voltage detection step of detecting the threshold voltage of the TFT 6 which is a driver element, by the threshold voltage detecting section 2. After the end of accumulation of the negative electric potential in the organic EL element 7 at the pre-processing step, the common line 9 becomes zero electric potential from the positive electric potential. To maintain the ON state of the TFT 8 which is the p-type TFT, the scan line 12 is with the negative electric potential as it is. By maintaining the TFT 8 in the ON state, the gate electrode and the drain electrode of the TFT 6 is shorted and connected to ground. Due to this, zero electric potential is applied to the gate electrode and the drain electrode of the TFT 6. Here, since the organic EL element 7 is connected to the source electrode of the TFT 6, based on the negative electric charge stored in the anode side of the organic EL element 7, voltage between the gate and the source of the TFT 6 becomes greater than the threshold voltage and the TFT 6 is put ON. Moreover, the drain electrode of the TFT 6 is connected electrically to ground whereas the source electrode of the TFT 6 is connected to the organic EL element 7 in which the negative electric charge is stored. Therefore, an electric potential difference is developed between the gate electrode and the source electrode of the TFT 6 and the current flows from the drain electrode to the source electrode. By flowing of the current, an absolute value of the negative electric charge stored in the organic EL element 7 decreases gradually and the voltage between the gate and the source of the TFT 6 also becomes low gradually. At a point where the voltage between the gate and the source of the TFT 6 is reduced up to the threshold voltage ($=V_{th1}$), the TFT 6 is put OFF and the absolute value of the negative electric charge stored in the organic EL element stops decreasing. Since the gate electrode of the TFT 6 is connected to ground, an electric potential of the source electrode of the TFT 6 when it is OFF is maintained at ($-V_{th1}$). Due to this; the threshold voltage ($-V_{th1}$) of the TFT 6 appears at the source electrode of the TFT 6 and the threshold voltage of the TFT 6 is detected. Further, at this step, the TFT 11 is maintained in OFF state since the scan line has negative potential and the threshold voltage detecting section 2 and the data writing section 1 are disconnected. Therefore, the operation in the data writing section does not affect this step. Further, the detection of the threshold voltage of the TFT 6 which is a driver element is performed by components of the threshold voltage detecting section 2 only and an operation of components of the data writing section 1 is not necessary.

A step shown in FIG. 2(*c*) and FIG. 3C is a data writing step of writing an electric potential corresponding to a brightness of the organic EL element by the data writing section 1 through the data line 3. The data line 3, in order to supply an electric potential corresponding to the brightness of the organic EL element 7, changes to an electric potential $V_{D1}$ corresponding to the brightness of the organic EL element 7 from a state when zero electric potential is indicated. Moreover, to write the electric potential supplied by the data line 3 in the pixel circuit, the TFT is put ON with the scan line 10 at a positive electric potential. Due to TFT 4 getting ON, the electric potential $V_{D1}$ is written from the data line 3 through the TFT 4 and the electric potential written is held in the capacitor 5. After the electric potential $V_{D1}$ written is held in the capacitor 5, the scan line 10 becomes a negative electric potential for putting the TFT 4 ON. Further, the scan line 12 has the negative potential as it is and the TFT 11 is maintained to be OFF. Therefore, the data writing section 1 and the threshold voltage detecting section 2 are disconnected electrically and the operation in the threshold voltage detecting section 2 does not affect this step. Thus, the data writing is performed by components of the data writing section 1 only and an operation of the threshold voltage detecting section 2 is not necessary. In other words, since the data writing is performed by the components of the data writing section 1 only and the detection of the threshold voltage is performed by the components of the threshold voltage detecting section 2 only, the data writing section 1 and the threshold voltage detecting section 2 function independently.

A step shown in FIG. 2(*d*) and FIG. 3D is a light-emitting process of emitting light by the organic EL element 7. In other words, it is a process in which the electric charge held in the capacitor 5 is supplied to the TFT 6, the TFT 6 is put ON and due to the current flow through the TFT 6 the organic EL element 7 emits light. To supply the electric charge held in the capacitor 5 to the gate electrode of the TFT 6, it is necessary to put ON the TFT 11 that is provided between the capacitor 5 and the gate electrode of the TFT 6 and to allow electric conduction. For this, the TFT 11 is put ON by allowing positive electric potential to the scan line 12 and the electric charge $V_{D1}$ that is held in the capacitor 5 is supplied to the gate electrode of the TFT 6. Due to the electric charge being supplied to the TFT 6, the TFT 6 is put ON. Here, the threshold voltage ($-V_{th1}$) that is detected in the source electrode at the threshold voltage detection step, appears in the TFT 6. At this step, since the electric potential $V_{D1}$ that is supplied by the capacitor 5 is applied to the gate electrode of the TFT 6, a voltage ($V_{D1}+V_{th1}$) is generated between the gate and source of the TFT 6. As a result, a current corresponding to the voltage between the gate and the source ($V_{D1}+V_{th1}$) flows through the TFT 6. Due to the current flow through the TFT 6 which is a driver element, the current also flows through the organic EL element 7 which is connected to the TFT 6 and the organic EL element 7 displays light of a brightness corresponding to the current flowing through the organic EL element 7. Further, since data writing is not performed at this step, it is necessary to put OFF the TFT 4 which controls the writing of the electric potential from the data line 3 and the scan line 10 is with the negative electric potential as it is.

Conventionally, in a TFT that is formed by using amorphous silicon, the threshold voltage tended to fluctuate and even if the same electric potential is written, due to the fluctuation in the threshold voltage the current flowing through an organic EL element differed and brightness of display became non-uniform. However, in the pixel circuit according to the first embodiment, the voltage between the gate and source of the TFT 6 is a sum of the writing electric potential $V_{D1}$ and the threshold voltage $V_{th1}$ of the TFT 6 and a current corresponding to the sum of the voltage flows through the TFT 6. Since a voltage in which the threshold voltage of the TFT 6 is added to the electric potential written $V_{D1}$ becomes the voltage between the gate and the source of the TFT 6, the fluctuation in the threshold voltage of the TFT 6 is compensated. As a result of this, the current flowing through the TFT 6 does not fluctuate and the organic EL element 7 displays light of uniform brightness, thereby suppressing the deterioration of the image quality. Description with reference to FIG. 4 is given below.

Figure 4:
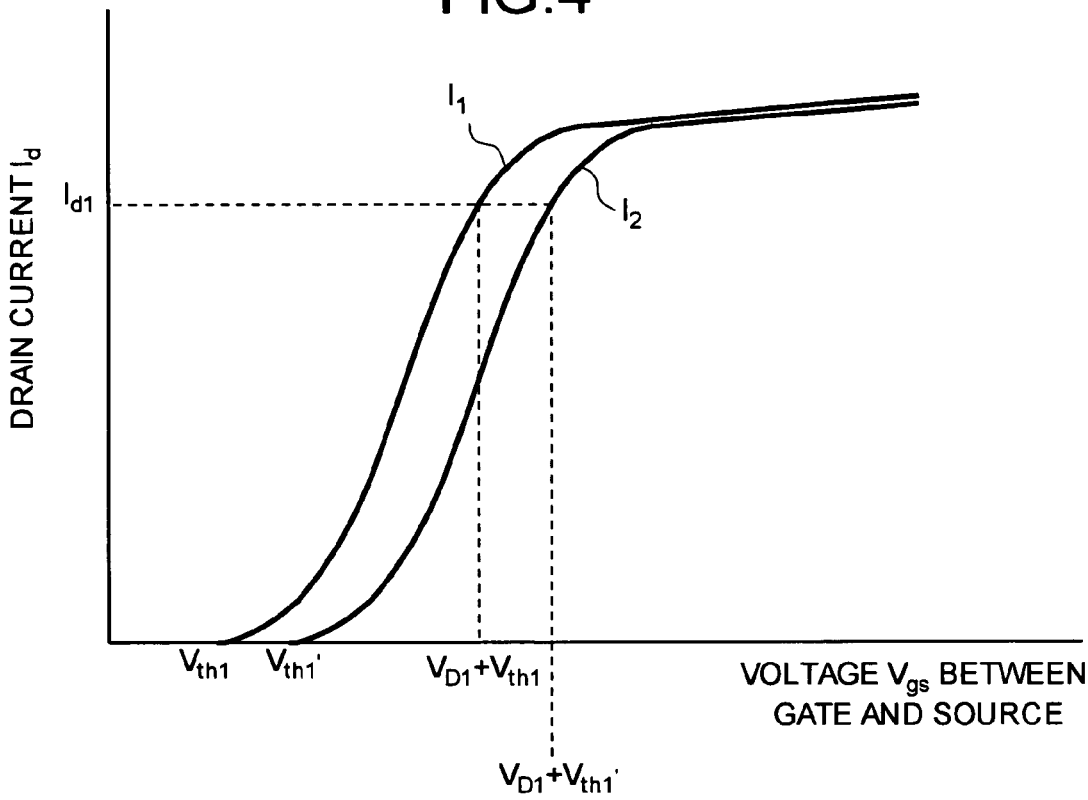
FIG. 4 is a graph that shows voltage-current characteristics of a TFT before deterioration and the TFT after deterioration.

FIG. 4 is a graph that shows voltage-current characteristics of the TFT 6 before deterioration and the TFT 6 after deterioration. In FIG. 4, a curve $l_1$ denotes characteristics of voltage $V_{gs}$ between the gate and the source of the TFT 6 and drain current $I_d$ before deterioration and a curve $l_2$ denotes characteristics of the TFT 6 after deterioration. Moreover, $V_{th1}$ and $V_{th1}'$ are threshold voltages of the TFT 6 before and after the deterioration. As shown in FIG. 4, the threshold voltages of the TFT 6 before deterioration and after deterioration are different. Here, in the pixel circuit according to the first embodiment, a voltage which is a sum of the threshold voltage that is detected by the threshold voltage detecting section 2 and the electric potential $V_{D1}$ that is written by the data writing section 1 becomes the voltage between the gate and the source of the TFT 6. Due to this, when the same electric potential $V_{D1}$ is written, the voltage between the gate and the source of the TFT 6 differs as $V_{D1}+V_{th1}$ and $V_{D1+Vth1}'$ respectively. However, even if the threshold voltages of the TFT 6 before and after the deterioration differ, a drain current for the both becomes $I_{d1}$ as shown in FIG. 4 and uniform current flows through the TFT 6. Therefore, even if the threshold voltage of the TFT 6 fluctuates, a predetermined current flows through the organic EL element and the organic EL element emits light of a predetermined brightness, thereby suppressing the deterioration of the image quality.

Further, in the display apparatus according to the first embodiment, by providing the TFT 8 as the second switching section, the gate electrode and the drain electrode of the TFT 6 are shorted at the threshold voltage detection step and the gate electrode and the drain electrode are connected to ground. As a result of this, in the TFT 6, there is a potential difference between the gate electrode and the source electrode that is connected to the organic EL element 7 which has stored the negative electric charge, and the current flows. After this, the voltage between the gate and the source becomes the threshold voltage ($V_{th1}$) and the TFT 6 is put OFF due to which the threshold voltage is detected in the source electrode. Therefore, by providing the TFT 8, the threshold voltage of the TFT 6 is detected by the components of the threshold voltage detecting section 2 only. Therefore, at the threshold voltage detections step, it is not necessary to make an electric potential of the gate electrode of the TFT 6, the TFT 11 and the data line 3 that is connected through the TFT 4, zero and the operation of the components of the data writing section 1 is not necessary for the detection of the threshold voltage.

Figure 5:
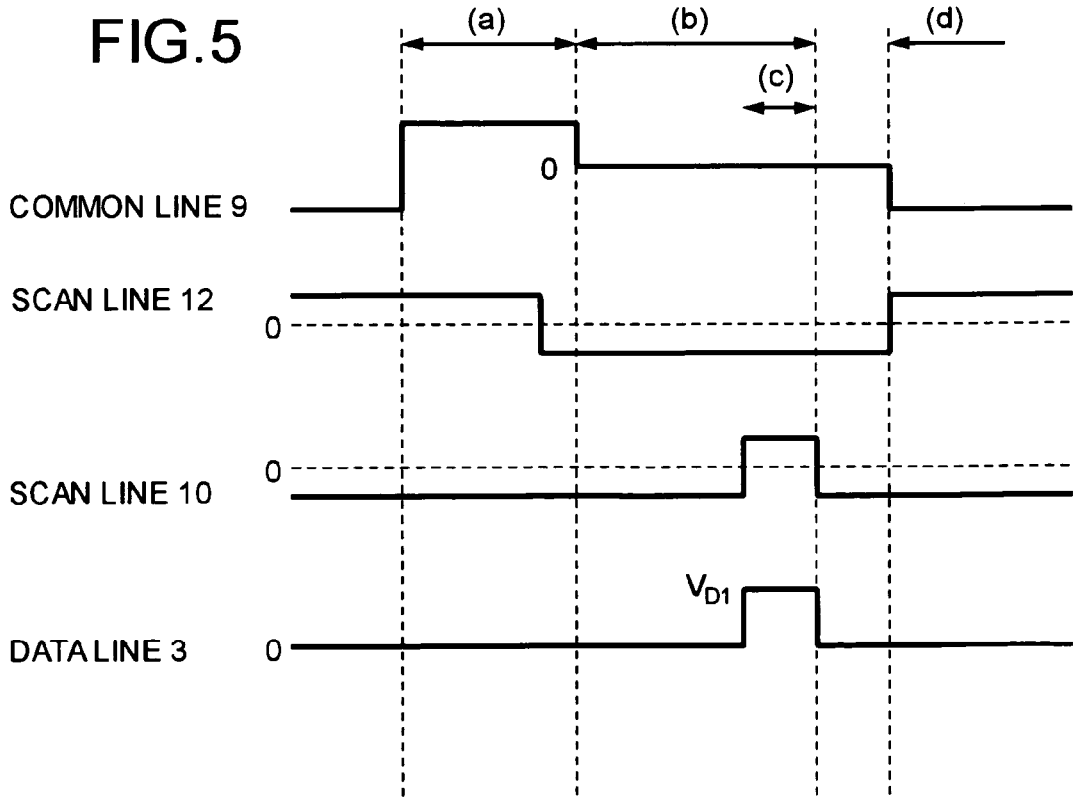
FIG. 5 is a timing chart of the pixel circuit shown in FIG. 1 in a case where operations of data writing and detection of threshold voltage of TFT which is a driver element are ended at the same time.

Moreover, in the display apparatus according to the first embodiment, the TFT 11 is provided between the data writing section 1 and the threshold voltage detecting section 2. Since the data writing section 1 and the threshold voltage detecting section 2 are disconnected by putting the TFT 11 OFF, it is possible to prevent effect of an operation on one side on the operation on the other side. For this reason, the threshold voltage detecting section 2 and the data writing section 1 can operate independently. Here, the timing chart of the pixel circuit shown in FIG. 1 when the operations of the data writing and the detection of the threshold voltage are ended at the same timing is indicated in FIG. 5. (a) to (d) of FIG. 5 are timing charts indicating the pre-processing step, the threshold voltage detection step, the data writing step, and the light emitting step respectively, similarly as indicated by (a) to (d) of FIG. 2. As mentioned above, since independent operations of the threshold voltage detecting section 2 and the data writing section 1 are possible, it is possible that they end at the same timing as shown in FIG. 5. Further, by ending the detection of the threshold voltage and the writing of the data at the same timing, reduction in time for all steps can be realized.

Furthermore, since a TFT in which the organic EL element 7 is disposed in series is the TFT 6 only which is a driver element, it is possible to reduce power consumption in a non-light emitting section other than the organic EL element 7. Further, since the TFTs at two locations, the TFT 8 and the TFT 11 are controlled by the scan line 12, a circuit structure is simple and efficiency of a power-supply voltage and efficiency of writing of the electric potential that is supplied to the organic EL element 7, are high.

Figure 6:
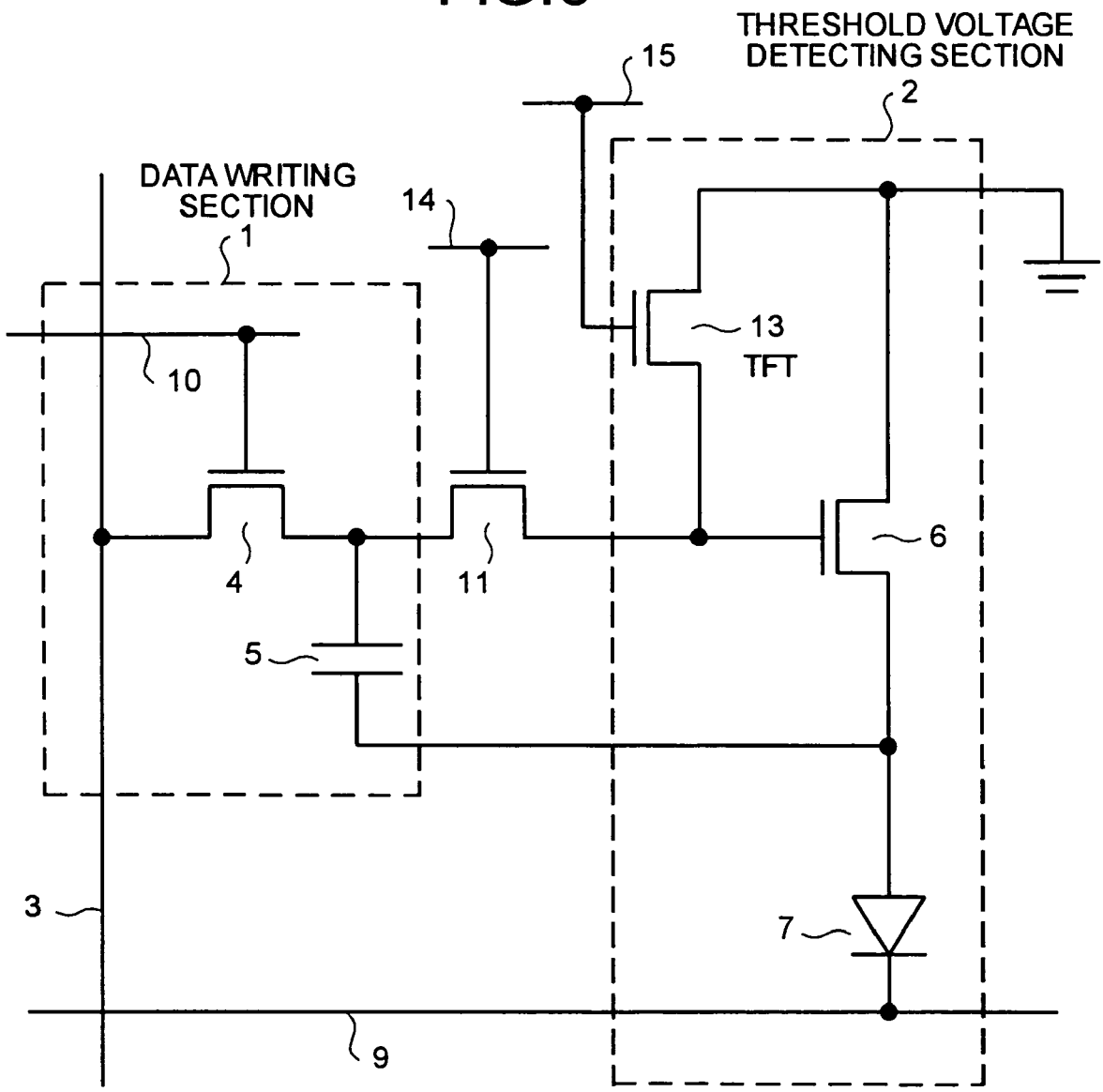
FIG. 6 is a diagram in which another example of a structure of the pixel circuit in the first embodiment in shown.

Moreover, although a structure in which the TFT 11 and the TFT 8 are controlled by one scan line 12 is shown in FIG. 1 as a pixel circuit according to the first embodiment, a structure in which different scan lines are connected to the TFT which is the second switching section and the TFT which is the third switching section respectively, may be used. For example, it is a structure as shown in FIG. 6 and the TFT 11 and a TFT 13 which is the second switching section are thin film transistors with identical conductivity type of channel layer like the n-type transistor. The TFT 13 functions as an example of a second switching section in the claims. In the pixel circuit, the TFT 11 is controlled by a scan line 14 and the TFT 13 is controlled by a separate scan line 15 other than the scan line 14. Steps of an operating method of a pixel circuit shown in FIG. 6 are similar to those shown in FIG. 3A to FIG. 3D and the second switching section and the third switching section which were controlled by the scan line 12 only in the timing chart shown in FIG. 2 are to be controlled by the scan line 14 and the scan line 15 respectively. In other words, when the TFT 11 which is the third switching section is to be put ON, the scan line 14 is allowed to have a positive electric potential with the same timing at which the scan line 12 indicates a positive electric potential and when the TFT 13 which is the second switching section is to be put ON, the scan line 15 is allowed to have positive electric potential with the same timing at which the scan line 12 indicates a negative electric potential.

Figure 7:
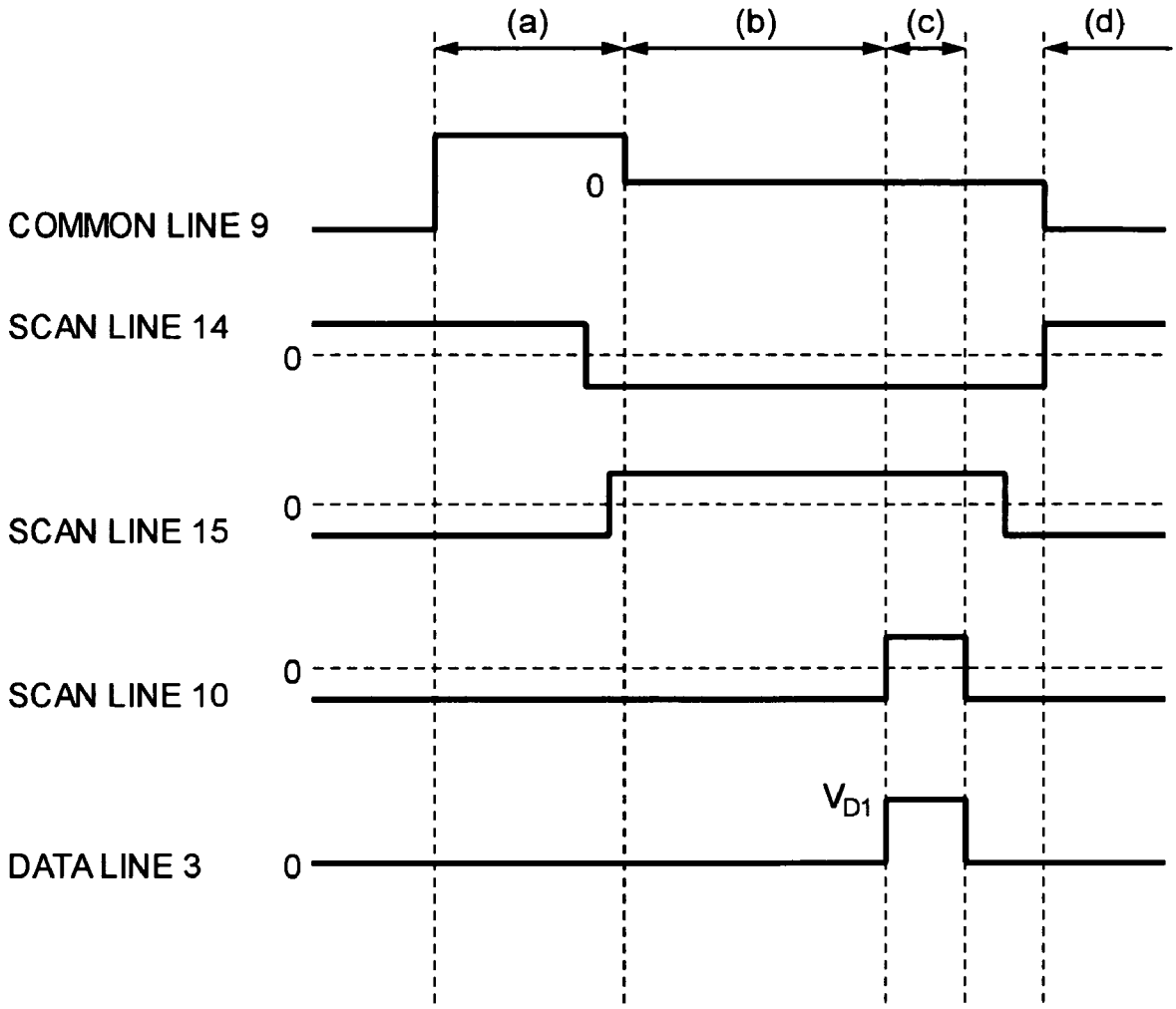
FIG. 7 is a timing chart of the pixel circuit shown in FIG. 6.

However, to prevent effectively the discharge of the electric charge that is held in the capacitor 5, it is desirable that each component of the pixel circuit shown in FIG. 6 operates according to a timing chart shown in FIG. 7. Here, (a) to (d) of FIG. 7 are timing charts indicating the pre-processing step, the threshold voltage detection step, the data writing step, and the light emitting step respectively, similarly as indicated by (a) to (d) of FIG. 2. At the pre-processing step shown in (a) of FIG. 7, after storing the negative charge in the organic EL element 7, the TFT 11 is put OFF before the TFT 13 is put ON. By operating the TFT 11 and the TFT 13 with these timings, the discharge through the TFT 13 of the electric charge that is held in the capacitor 5 to ground, is prevented effectively. Further, after an end of the data writing step shown in (c) of FIG. 7, the scan line 15 is allowed to have negative electric potential to put the TFT 13 OFF. By operating the TFT 13 with this timing, the discharge through the TFT 13 of the writing electric potential held in the capacitor 5 to ground is prevented.

Thus, since each component of the pixel circuit shown in FIG. 6 controls drive of the TFT 13 which is the second switching section and the TFT 11 which is the third switching section, with independent scan lines, it is possible to have an operation according to the timing chart in FIG. 7. As a result of this, it is possible to prevent effectively the discharge of the electric charge that is held in the capacitor 5. Further, since the pixel circuit shown in FIG. 6 includes only the TFTs which have the same conductivity type of channel layer, it is possible to reduce the manufacturing cost.

Moreover, in the first embodiment, apart from displaying an image by a method in which the data writing step is performed for each row or column and the light emitting step is performed one after another for each row or column, the image may be displayed by an overall collective control method of displaying one screen simultaneously by allowing all the organic EL elements 7 to emit light simultaneously. Further, in the first embodiment, the pre-processing step may be performed simultaneously for all the pixel circuits. In other words, the electric charge may be allowed to be stored in all the organic EL elements 7 simultaneously. Moreover, in the first embodiment, the threshold voltage detection step may be performed for all the pixel circuits simultaneously. In other words, all the TFTs 8 are put ON simultaneously and the drain electrode and the gate electrode of the TFT 6 may be shorted.

Further, a display apparatus according to a second embodiment is described. A pixel circuit in the display apparatus according to the second embodiment has a data writing section that includes a data line, a first switching section, and a capacitor and writes an electric potential corresponding to a brightness of light emitted and a threshold voltage detecting section that includes a second switching section and a current light emitting element and detects threshold voltage of a driver element. Moreover, it has a structure that includes a TFT as a switching section that controls supply of electric charge from the capacitor to the driver element. Due to the pixel circuit, the structure is such that the data writing section and the threshold voltage detecting section operate independently. Further, by applying to the driver element an electric potential in which a threshold voltage that is detected by the threshold voltage detecting section which can function independently from the data writing section to an electric potential that is written by the data writing section, a display apparatus that supplies a uniform current to the current light emitting element even when the threshold voltage of the driver element fluctuates, can be realized.

Figure 8:
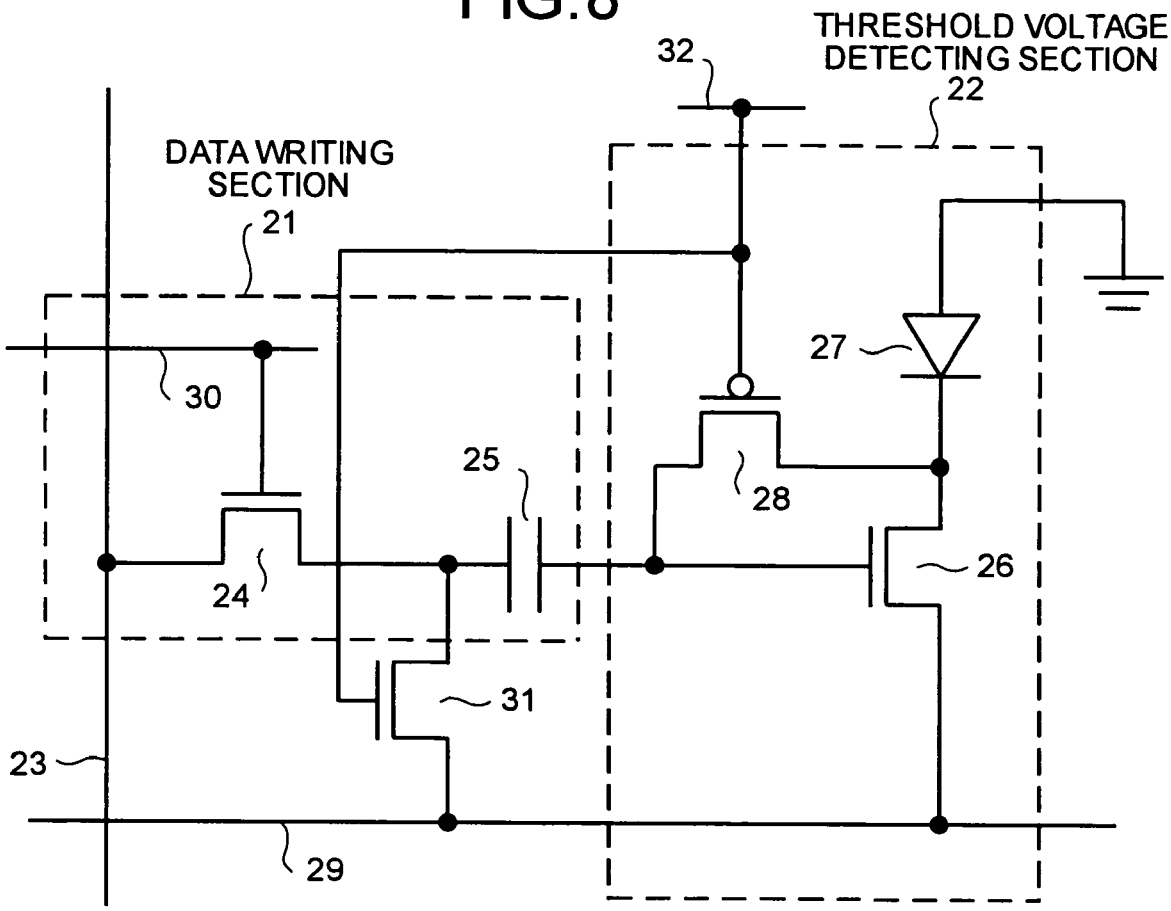
FIG. 8 is a diagram in which a structure of a pixel circuit in a second embodiment is shown.

FIG. 8 is a diagram in which a structure of the pixel circuit in the first embodiment is shown. The pixel circuit, as shown in FIG. 1, is equipped with a data writing section 21 that includes a data line 23 which supplies an electric potential corresponding to a brightness of the current light emitting element, a TFT 24 which is a first switching section that controls the writing of the electric potential, a capacitor 25 that holds the electric potential that is written, and a scan line 30 which is a first scan line that is connected to a gate electrode of the TFT 24. The data writing section 21 functions as an example of a data writing section in the claims. The data line 23 functions as an example of a data line in the claims. The TFT 24 functions as an example of a first switching section in the claims. The scan line 30 functions as an example of a first scan line in the claims. Further, the capacitor 25 is disposed between the data writing section 21 and a threshold voltage detecting section 22 and has a negative electrode which is a first electrode that is connected electrically to the data writing section 21 and a positive electrode which is a second electrode that is connected electrically to the threshold voltage detecting section 22.

Moreover, the pixel circuit in the second embodiment is equipped with a threshold voltage detecting section 22 that includes a TFT 26 which is a driver element, a TFT 28 that is a second switching section, an organic EL element 27 which is a current light emitting element, and a common line 29 which a power-supply line that is connected to a source electrode of the TFT 26. The threshold voltage detecting section 22 functions as an example of a threshold voltage detecting section in the claims. The TFT 28 functions as an example of a second switching section in the claims. The TFT 26 functions as an example of a driver element in the claims and has a function of controlling the current according to the electric potential that is written by the data writing section 21. The organic EL element 27 functions as an example of a current light emitting element in the claims. The common line 29 functions as an example of a power-supply in the claims.

Moreover, a TFT 31 which is a fourth switching section that connects the source electrode to the common line 29 is connected to the negative electrode of the capacitor 25. The TFT 31 functions as an example of a fourth switching section in the claims and controls an electric potential of the negative electrode of the capacitor 25. The display apparatus according to the second embodiment is formed by disposing the pixel circuit in the form of a matrix. Furthermore, to facilitate the description, regarding the TFT 26, an electrode that is connected to the organic EL element 27 is let to be a drain electrode and an electrode that is connected to the common line 29 is let to be a source electrode.

An electric potential corresponding to a display brightness of the organic EL element 27 is applied by the data line 23 to the data writing section 21 and the data writing section 21 has a function of holding the electric potential applied. The data line 23, the TFT 24 which is the first switching section, the capacitor 25 and the scan line 30 which is the first scan line in the data writing section 1 have functions similar to those of components in the data writing section 1 in the pixel circuit described in the first embodiment. Moreover, the capacitor 25 also has a function of isolating electrically the data writing section 21 and the threshold voltage detecting section 22.

The threshold voltage detecting section 22 has a function of detecting a threshold voltage of the TFT 26 which is a driver element. The TFT 26 in the threshold voltage detecting section 22 has a function of supplying a current corresponding to a voltage between a gate and a source to the organic EL element 27 when the TFT 26 is put ON. Although the organic EL element 27 is primarily for displaying light of a brightness corresponding to a current that is applied when the TFT 26 is ON, in the threshold voltage detecting section 22, it functions as a capacitor that supplies electric charge to the gate electrode and the drain electrode of the TFT 26. Further, the TFT 28 has a function of short-circuiting the gate electrode and the drain electrode of the TFT 26 when it is put ON. As mentioned in the latter part, in the display apparatus according to the second embodiment, by providing the TFT 28, detection of threshold voltage of the TFT 26 is made possible without using components like the data line 23 etc. of the data writing section 21. Moreover, ON state of the TFT 28 is controlled by a scan line 32. The common line 29 has a function similar to that of the common line 9 described in the first embodiment. Further, the scan line 32 functions as an example of a third scan line in the claims.

Moreover, the TFT 31 is provided between the negative electrode of the capacitor 25 and the common line 29, and has a function of controlling electric conduction between the capacitor 25 and the common line 29. The TFT 31 controls the transfer of electric charge from the capacitor 25 to the TFT 26 which is a driver element by controlling the connection between the negative electrode of the capacitor 25 and the common line 29 of which the polarity of electric potential changes in each process mentioned in the latter part. In other words, the electric charge is transferred from the capacitor 25 to the TFT 26 due to flowing of current through the TFT 31 when the TFT is put ON and a predetermined electric potential is allowed to be generated between the gate electrode and the source electrode of the TFT 26. As a result of this the TFT 31 is put ON and due to the current flow through the TFT 31, the electric charge is transferred between the data writing section 21 and the threshold voltage detecting section 22, and the data writing section 21 and the threshold voltage detecting section 22 are connected electrically.

Moreover, the TFT 31 has an opposite conductivity type of channel layer compared to that of the TFT 28 in the threshold voltage detecting section. Furthermore, both of a gate electrode of the TFT 31 and a gate electrode of the TFT 28 are connected to the scan line 32 and according to the polarity of the electric potential that is supplied to the scan line 32, any one of the TFT 28 and the TFT 31 is put ON. For example, if the TFT 28 is a p-type TFT as shown in FIG. 8, the TFT 31 is an n-type TFT. To put the TFT 31 ON, it is necessary to make an electric potential of the scan line 32 the positive potential and to put the TFT 28 ON, it is necessary to make an electric potential of the scan line 32 the negative potential. Moreover, the TFT 31 may be let to be a p-type TFT and the TFT 28 may be let to be an n-type TFT and in this case, to put the TFT 31 ON, it is necessary to make an electric potential of the scan line 32 the negative potential and to put the TFT 28 ON, it is necessary to make an electric potential of the scan line 32 the positive potential. As mentioned in the latter part, the TFT 28 which is the second switching section and the TFT 31 which is the fourth switching section may be allowed to be TFTs which have the same conductivity type of channel layer and in such a case, the TFT which is the second switching section and the TFT which is the fourth switching section are to be controlled by different scan lines.

Figure 9:
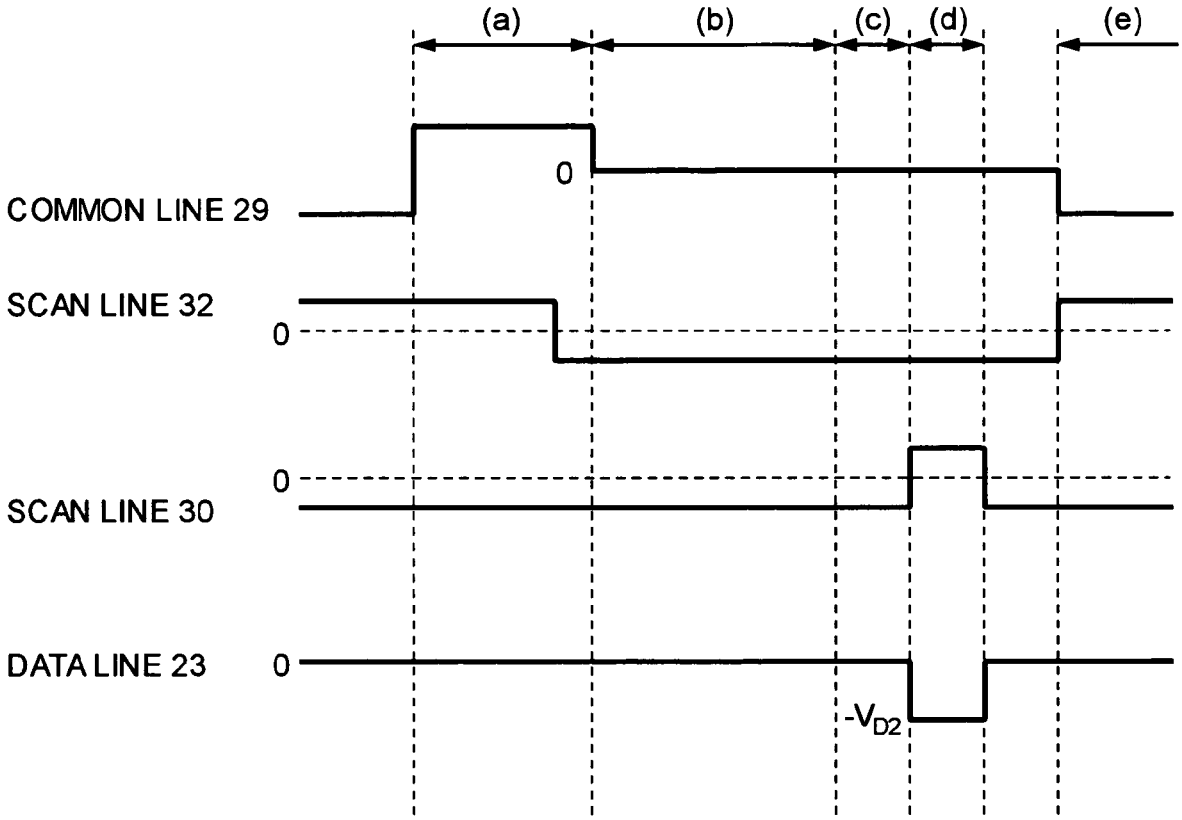
FIG. 9 is a timing chart of the pixel circuit shown in FIG. 8.
Figure 10A:
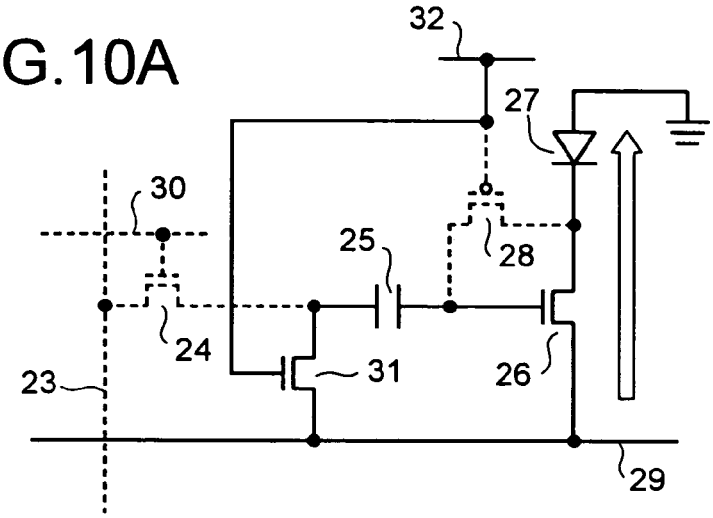
FIG. 10A is a diagram that shows a step of an operating method of the pixel circuit in (a) shown in FIG. 9.
Figure 10B:
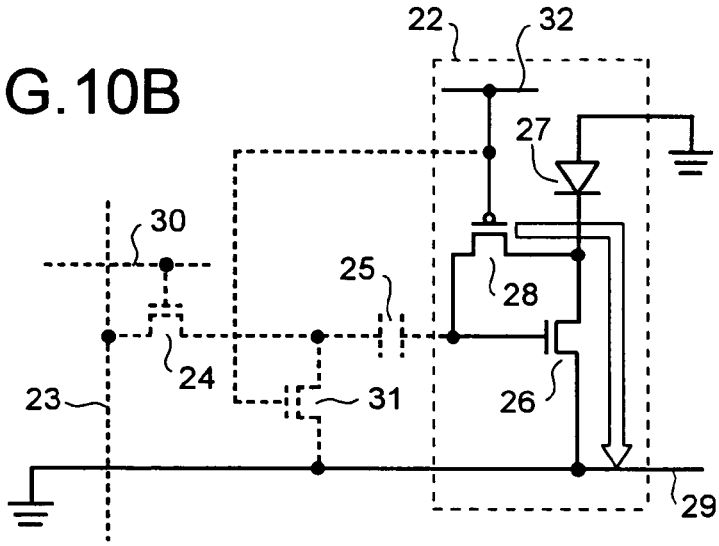
FIG. 10B is a diagram that shows a step of an operating method of the pixel circuit in (b) shown in FIG. 9.
Figure 10C:
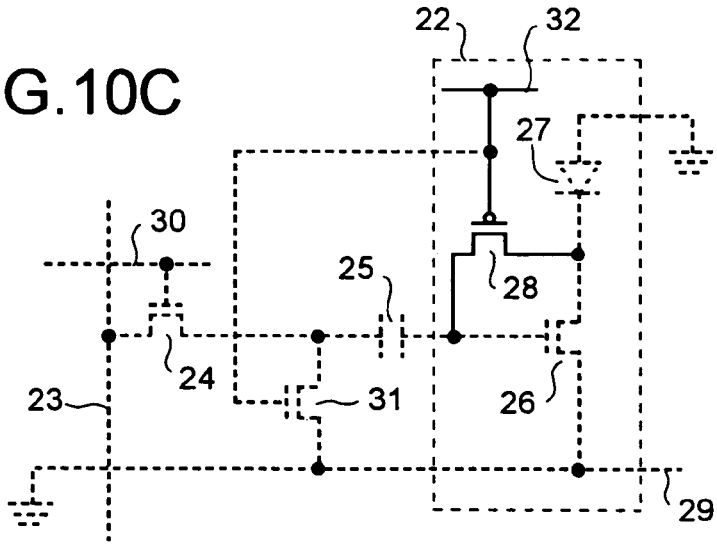
FIG. 10C is a diagram that shows a step of an operating method of the pixel circuit in (c) shown in FIG. 9.
Figure 10D:
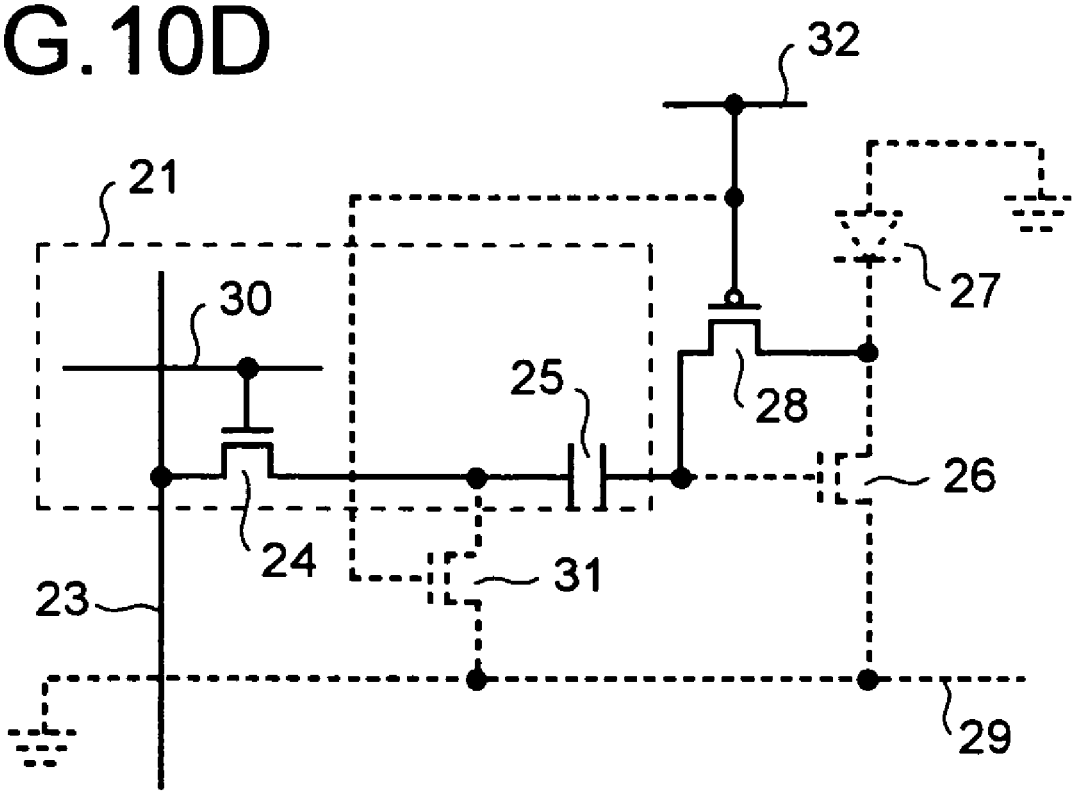
FIG. 10D is a diagram that shows a step of an operating method of the pixel circuit in (d) shown in FIG. 9.
Figure 10E:
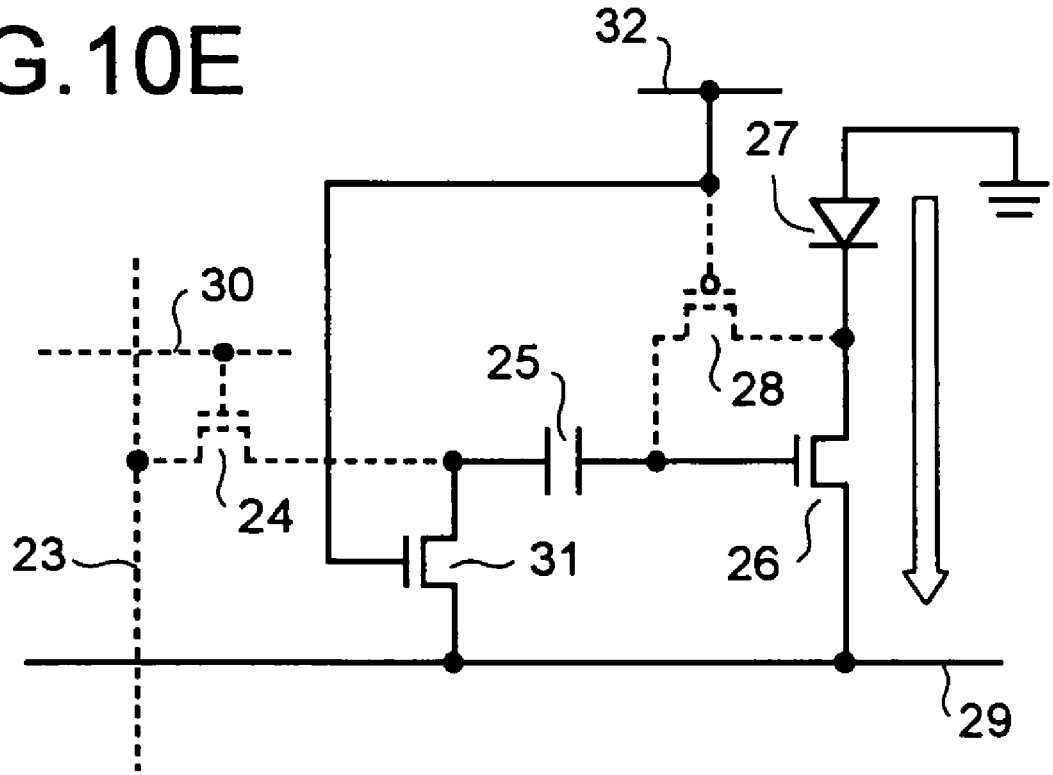
FIG. 10E is a diagram that shows a step of an operating method of the pixel circuit in (e) shown in FIG. 9.
Figure 11:
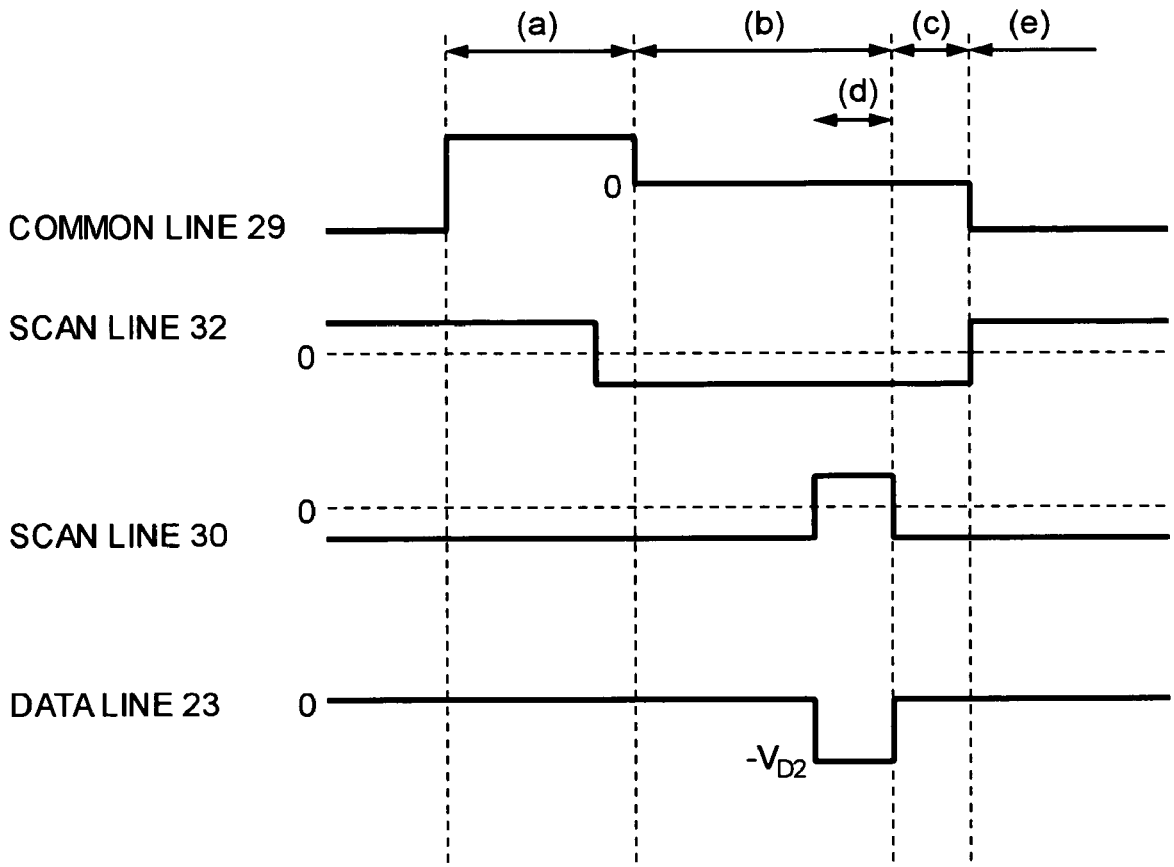
FIG. 11 is a timing chart of the pixel circuit shown in FIG. 8 in a case where operations of data writing and detection of threshold voltage of TFT which is a driver element, are ended at the same time.

Further, an operation of the pixel circuit shown in FIG. 8 is described by referring to FIG. 9 and FIG. 10A to FIG. 10D. FIG. 9 is a timing chart of the pixel circuit according to the second embodiment. FIG. 10A is a diagram that shows a step of an operating method of the pixel circuit in (a) shown in FIG. 9, FIG. 10B is a diagram that shows a step of an operating method of the pixel circuit in (b) shown in FIG. 9, FIG. 10C is a diagram that shows a step of an operating method of the pixel circuit in (c) shown in FIG. 9, FIG. 10D is a diagram that shows a step of an operating method of the pixel circuit in (d) shown in FIG. 9, and FIG. 10E is a diagram that shows a step of an operating method of the pixel circuit in (e) shown in FIG. 9. In the display apparatus according to the second embodiment, as shown in (a) to (e) of FIG. 9 and FIG. 10A to FIG. 10E, the data writing and the threshold voltage detection are performed by independent steps. In FIG. 10A to FIG. 10D, solid lines indicate portions through which current flows and dashed lines indicate portions through which no current flows.

A step shown in (a) of FIG. 9 and FIG. 10A is a pre-processing step of storing electric charge in the organic EL element 7 as the previous step of the threshold voltage detection. Concretely, it is a step of storing electric charge in the organic EL element 27 by allowing a current flow in the TFT 26 in a direction opposite to that during the emission of light. At this step, similarly as at the pre-processing step of the pixel circuit in the first embodiment, the positive electric charge which is sufficiently greater than an electric charge that is remained in the capacitor 25, is stored in the anode side due to inverting the polarity of the electric potential of the common line 29 compared to that during the emission of light.

A step shown in (b) of FIG. 9 and FIG. 10B is a threshold voltage detection step of detecting the threshold voltage of the TFT 26 which is the driver element, by the threshold voltage detecting section 22. After the end of storing the positive electric charge in the organic EL element 27 at the pre-processing step, the common line 29 becomes zero electric potential from the positive electric potential., Since the scan line 29 is with the negative electric potential as it is, by maintaining the ON state of the TFT 28, the gate electrode and the drain electrode of the TFT 26 are shorted and have the same electric potential. Here, since the organic EL element 27 is connected to the drain electrode of the TFT 26, the positive electric charge that is stored in the organic EL element 27 is supplied to the gate electrode of the TFT 26 which is shorted by the drain electrode of the TFT 26 and the TFT 28. Moreover, at this step, since the common line 29 becomes zero electric potential from the positive electric potential, zero electric potential is applied to the source electrode of the TFT 26 which is connected to the common line 29. Therefore, the voltage between the gate and the source of the TFT 26 becomes greater than the threshold voltage, and the TFT 26 is put ON. Due to the electric potential difference developed between the gate electrode and the source electrode of the TFT 26, the current flows from the drain electrode to the source electrode. Due to the current flow through the TFT 26, the positive electric charge that was stored in the organic EL element 27 decreases gradually and the voltage between the gate and the source of the TFT 26 also becomes low gradually. At a point where the voltage between the gate and the source of the TFT 26 is reduced up to the threshold voltage ($=V_{th2}$), the TFT 26 is put OFF and the positive electric charge stored in the organic EL element 27 stops decreasing. Here, since the source electrode of the TFT 26 is connected to the common line 29 which has zero electric potential and the gate electrode and the drain electrode of the TFT 26 are connected to the organic EL element 27, after the TFT 26 is put OFF, the electric potential of the gate electrode and the drain electrode of the TFT 26 is maintained at $V_{th2}$. Due to this, the threshold voltage $V_{th2}$ of the TFT 26 appears at the gate electrode and the drain electrode of the TFT 26 and the threshold voltage of the TFT 26 is detected. Further, the detection of the threshold voltage of the TFT 26 is performed by components of the threshold voltage detecting section 22 only and an operation of components of the data writing section 21 is not necessary.

(c) of FIG. 9 and FIG. 10C are a threshold voltage holding step of holding the threshold voltage of the TFT 26 that is detected. Since the TFT 31 maintains the OFF state, the threshold voltage $V_{th2}$ of the TFT 26 appeared at the gate electrode and the drain electrode of the TFT 26 is held at the positive electrode of the capacitor 25. By putting the TFT 31 OFF, the electric charge that is held in the capacitor 25 is not transferred and is held continuously.

(d) of FIG. 9 and FIG. 10D are a data writing step. Similarly as in the data writing step of the pixel circuit in the first embodiment, an electric potential corresponding to a brightness of the organic EL element 27 is written from the data line 23 through the TFT 24 and is held in the capacitor 25. Further, the electric potential written at this step is ($-V_{D2}$). Since the threshold voltage $V_{th2}$ of the TFT 26 that is detected at the threshold voltage detection step is held in the positive electrode of the capacitor 25, an electric charge corresponding to a voltage that is a sum of the threshold voltage of the TFT 26 and the electric potential written, is held in the capacitor 25. Moreover, since the TFT 31 maintains the OFF state, the data writing section 21 and the threshold voltage detecting section 22 are isolated electrically and the operation in the threshold voltage detecting section 22 does not affect this step. Thus, the data writing is performed by an operation of the components of the data writing section 21 only, and an operation of the threshold voltage detecting section 22 is not necessary. In other words, since the data writing is performed by an operation of the components of the data writing section 21 only and the detection of the threshold voltage is performed by an operation of the components of the threshold voltage detecting section 22 only, the data writing section 21 and the threshold voltage detecting section 22 function independently.

(e) of FIG. 9 and FIG. 10E are a light-emitting step of emitting light by the organic EL element 27. In other words, it is a process in which the electric charge held in the capacitor 25 is supplied to the TFT 26 which is the driver element, the TFT 26 is put ON, and due to flowing of current in the TFT 26, the organic EL element 27 emits light. Here, to supply the electric charge held in the capacitor 25 to the gate electrode of the TFT 26, it is necessary to put ON the TFT 31. For this, the TFT 31 is put ON by allowing positive electric potential to the scan line 32. By putting the TFT 31 on, while a potential difference is maintained between the negative electrode and the positive electrode of the capacitor 25, an electric charge of the same amount and different polarity as that of the electric charge held in the negative electrode is generated in the positive electrode of the capacitor 25 and the electric charge held in the negative electrode of the capacitor 25 is eliminated. In other words, by putting the TFT 31 ON, the electric potential of the negative electrode of the capacitor 25 rises up to ground electric potential and the electric potential ($-V_{D2}$) held in the negative terminal is applied to the positive terminal of the capacitor 25 and ($V_{D2}+V_{th2}$) appears. This electric potential is applied to the gate electrode of the TFT 26 and the TFT 26 is put ON. Since the drain electrode of the TFT 26 is connected to the organic EL element 27 and the source electrode is connected to the common line 29 that has negative potential, a voltage ($V_{D2}+V_{th2}$) is generated between the gate and the source of the TFT 26 and a current corresponding to the voltage between the gate and the source flows from the drain electrode to the source electrode. Due to the current flow through the driver element, the current also flows through the organic EL element 27 that is connected to the TFT 26 and the organic EL element 27 displays light of a brightness corresponding to the current flowing through the organic EL element 27. Further, since data writing is not performed at this step, the TFT 24 is maintained at OFF state.

In the display apparatus according to the second embodiment, similarly as in the display apparatus according to the first embodiment, the voltage between the gate and the source of the TFT 26 which is a driver element at the light-emitting step, is a sum of the electric potential $V_{D2}$ that is written and the threshold voltage of the TFT 26 $V_{th2}$, and a current corresponding to the sum of the voltages flows through the TFT 26. Therefore, since the voltage in which the threshold voltage of the TFT 26 is added to the electric potential written, $V_{D2}$ becomes the voltage between the gate and the source of the TFT 26, the fluctuation in the threshold voltage of the TFT 26 is compensated. As a result of this, the current flowing through the TFT 26 does not fluctuate and the organic EL element 27 displays light of uniform brightness, thereby suppressing the deterioration of the image quality.

Moreover, in the display apparatus according to the second embodiment, by providing the TFT 28 as the second switching section, at the threshold voltage detection step, the gate electrode and the drain electrode of the TFT 26 are shorted and allowed to have the same electric potential. Current flows due to an electric potential difference developed between the gate electrode and the source electrode which is connected to the common line 29 which has zero electric potential, the voltage between the gate and the source becomes the threshold voltage ($V_{th2}$), and because the TFT 26 is put OFF, the threshold voltage is detected in the gate electrode. Therefore, by providing the TFT 28, the threshold voltage of the TFT 26 is detected by the components of the threshold voltage detecting section 22 only. Therefore, an operation of the components of the data writing section 21 is not necessary for the detection of the threshold voltage.

Moreover, in the display apparatus according to the second embodiment, the data writing section 21 and the threshold voltage detecting section 22 are connected electrically due to flowing of current through the TFT 31 when the TFT 31 is put ON. Further, the capacitor 25 which is an insulator is provided at a boundary of the data writing section 21 and the threshold voltage detecting section 22.

Therefore, since the data writing section 21 and the threshold voltage detecting section 22 are separated by a boundary of the insulator, they are isolated electrically when the TFT 31 is OFF. For this reason, it is possible to prevent effect of an operation on one side on the operation on the other side. And by ending the detection of the threshold voltage and the writing of the data at the same timing, reduction in time for all steps can be realized.

Furthermore, since a TFT in which the organic EL element 27 is arranged in series is the TFT 26 only which is a driver element, it is possible to reduce power consumption in a non-light emitting section other than the organic EL element 27. Further, since the TFTs at two locations, the TFT 28 and the TFT 31 are controlled by the scan line 32, a circuit structure is simple and efficiency of a power-supply voltage and efficiency of writing of the electric potential that is supplied to the organic EL element 27, are high.

Figure 12:
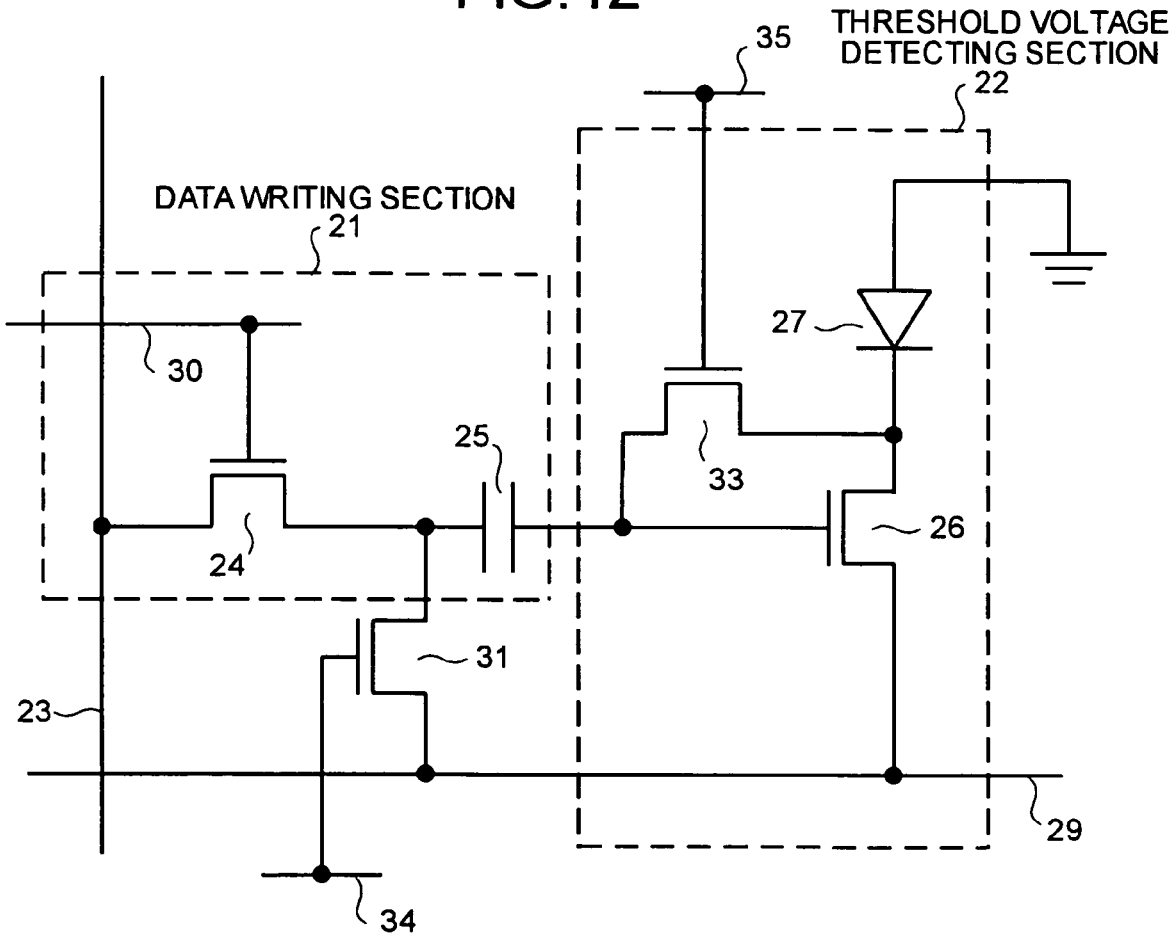
FIG. 12 is a diagram in which another example of a structure of the pixel circuit in the second embodiment is shown.

Moreover, although a structure in which the TFT 31 and the TFT 28 are controlled by one scan line 32 is shown in FIG. 8 as a pixel circuit according to the second embodiment, a structure in which different scan lines are connected to the TFT which is the second switching section and the TFT which is a fourth switching section respectively, may be used. For example, it is a structure as shown in FIG. 12 and the TFT 31 and a TFT 33 which are the second switching section are thin film transistors with identical conductivity type of channel layer like the n-type transistor. In this pixel circuit, the TFT 31 is controlled by the scan line 34 and the TFT 33 is controlled by a scan line 35 which is different from the scan line 34. The TFT 33 functions as an example of a second switching section in the claims.

Steps of operating method of a pixel circuit shown in FIG. 12 are similar to those shown in FIG. 10A to FIG. 10E and the second switching section and the fourth switching section which were controlled by the scan line 32 only in the timing chart shown in FIG. 9 are to be controlled by the scan line 34 and the scan line 35 respectively. In other words, when the TFT 31 which is the third switching section is to be put ON, the scan line 34 is allowed to have a positive electric potential with the same timing at which the scan line 32 indicates a positive electric potential and when the TFT 33 which is the second switching section is to be put ON, the scan line 35 is allowed to have positive electric potential with the same timing at which the scan line 32 indicates a negative electric potential.

Figure 13:
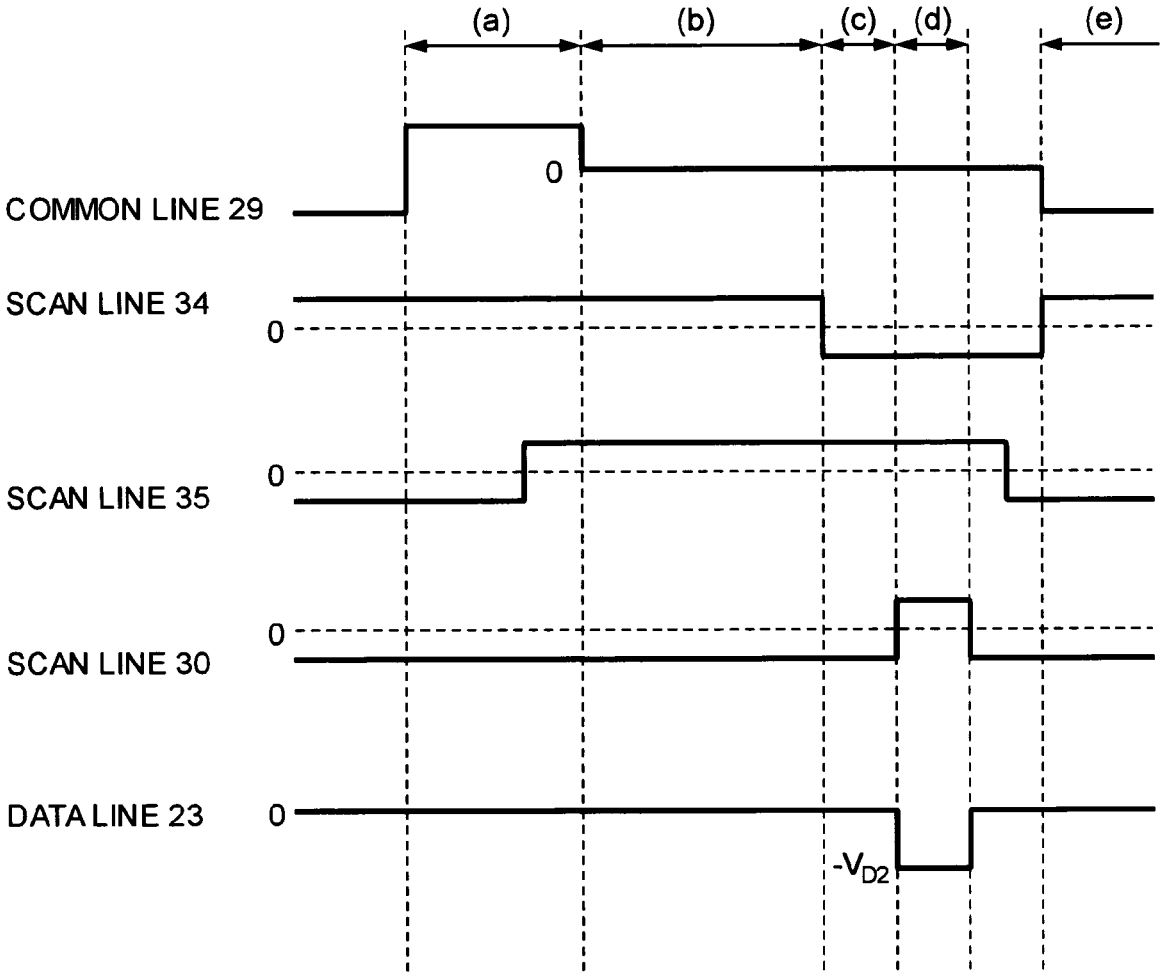
FIG. 13 is a timing chart of the pixel circuit shown in FIG. 12.

However, to prevent effectively the discharge of the electric charge that is held in the capacitor 25, it is desirable that each component of the pixel circuit shown in FIG. 12 operates according to a timing chart shown in FIG. 13. Here, (a) to (e) of FIG. 13 are timing charts indicating the pre-processing step, the threshold voltage detection step, the threshold voltage holding step, the data writing step, and the light emitting step respectively, similarly as in (a) to (e) of FIG. 9. In the timing chart shown in FIG. 13, the TFT 31 is put OFF at the end of the threshold voltage detection step shown in (b) of FIG. 13. Since the TFT 31 is put OFF at this timing, the connection of the negative terminal of the capacitor 25 and the common line 29 that shows zero electric potential at the threshold voltage detection step is maintained. As a result of this, at the threshold voltage detection step, the threshold voltage of the TFT 26 which is connected to the organic EL element 27 that stores a large electric charge is detected to be stable. Further, even when a difference between a writing electric potential of a previous frame and a writing electric potential of a current frame is large, a predetermined electric potential is written in the capacitor 25 without being affected by the previous frame at the data writing step, and it is possible to realize a stable gradation. Further, after an end of the data writing step shown in (d) of FIG. 13, the scan line 35 is allowed to have negative electric potential to put the TFT 33 OFF before putting the TFT 31 ON. By operating the TFT 33 with this timing, the discharge through the TFT 33 of the writing electric potential held in the capacitor 25 to ground is prevented.

Thus, since each component of the pixel circuit shown in FIG. 12 controls drive of the TFT 33 which is the second switching section and the TFT 31 which is the fourth switching section, with independent scan lines, it is possible to have an operation according to the timing chart shown in FIG. 13. As a result of this, it is possible to prevent effectively, the discharge of the electric charge that is held in the capacitor 25 and to realize the stable gradation. Further, since the pixel circuit shown in FIG. 12 includes only the TFTs which have the same conductivity type of channel layer, it is possible to reduce the manufacturing cost.

Moreover, in the second embodiment, apart from displaying an image by a method in which the data writing step is performed for each row or column and the light emitting step is performed one after another for each row and column, the image may be displayed by an overall collective control method of displaying one screen simultaneously by allowing all the organic EL elements 27 to emit light simultaneously. Further, in the second embodiment, the pre-processing step may be performed simultaneously for all the pixel circuits. In other words, the electric charge may be allowed to be stored in all the organic EL elements 27 simultaneously. Moreover, in the second embodiment, the threshold voltage detection step may be performed simultaneously for all the pixel circuits. In other words, all the TFTs 28 are put ON simultaneously and the drain electrode and the gate electrode of the TFT 26 may be shorted.

In FIG. 12, the pixel circuit that includes four TFTs and one capacitor is described and by causing a predetermined reference electric potential be supplied to the data line 23, and by causing electrical conduction between the data line 23 and the capacitor 25 by putting the TFT 24 ON while supplying the reference electric potential to the data line 23, the TFT 31 can be omitted and a pixel circuit having a simple circuit can be built.

Figure 14:
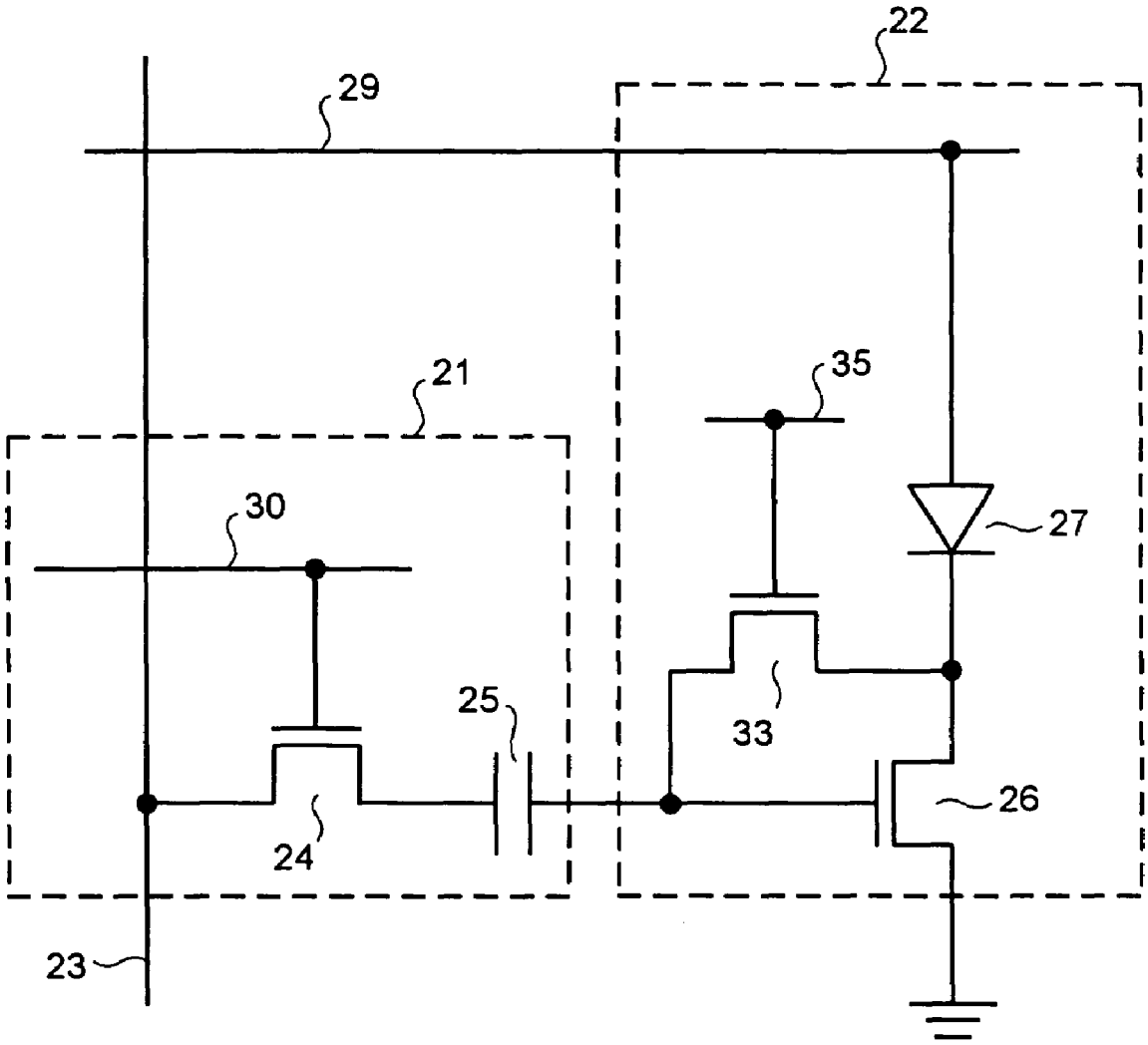
FIG. 14 is a diagram in which another example of a structure of the pixel circuit in the second embodiment is shown.

FIG. 14 is a diagram in which another example of a structure of the pixel circuit in the second embodiment is shown. In the pixel circuit shown in FIG. 14, the TFT 31 and the scan line 34 that controls the TFT 31 in the pixel circuit in FIG. 12, are omitted. Further, as mentioned in the latter part, a reference electric potential, for example zero electric potential is supplied to the data line 23, and by electrical conduction between the data line 23 and the negative electrode of the capacitor 25 by putting the TFT 24 ON while supplying the reference electric potential to the data line 23, the supply of the electric charge from the capacitor 25 to the TFT 26 is controlled and each step is performed. Further, in the pixel circuit shown in FIG. 14, an anode side of the organic EL element 27 is connected to the common line 29 and the source electrode of the TFT 26 is connected to ground. Moreover, in the display apparatus that includes the pixel circuit shown in FIG. 14, as mentioned in the latter part, an image is displayed by an overall collective control method of displaying one screen simultaneously by allowing all the organic EL elements 27 to emit light of a predetermined brightness simultaneously. Further, similarly as in the pixel circuit shown in FIG. 12, the data line 23, the TFT 24, the capacitor 25, and the scan line 30 are included in the data writing section 21 and the TFT 26, the TFT 33, the organic EL element 27, and the common line 29 are included in the threshold voltage detecting section 22.

Figure 15:
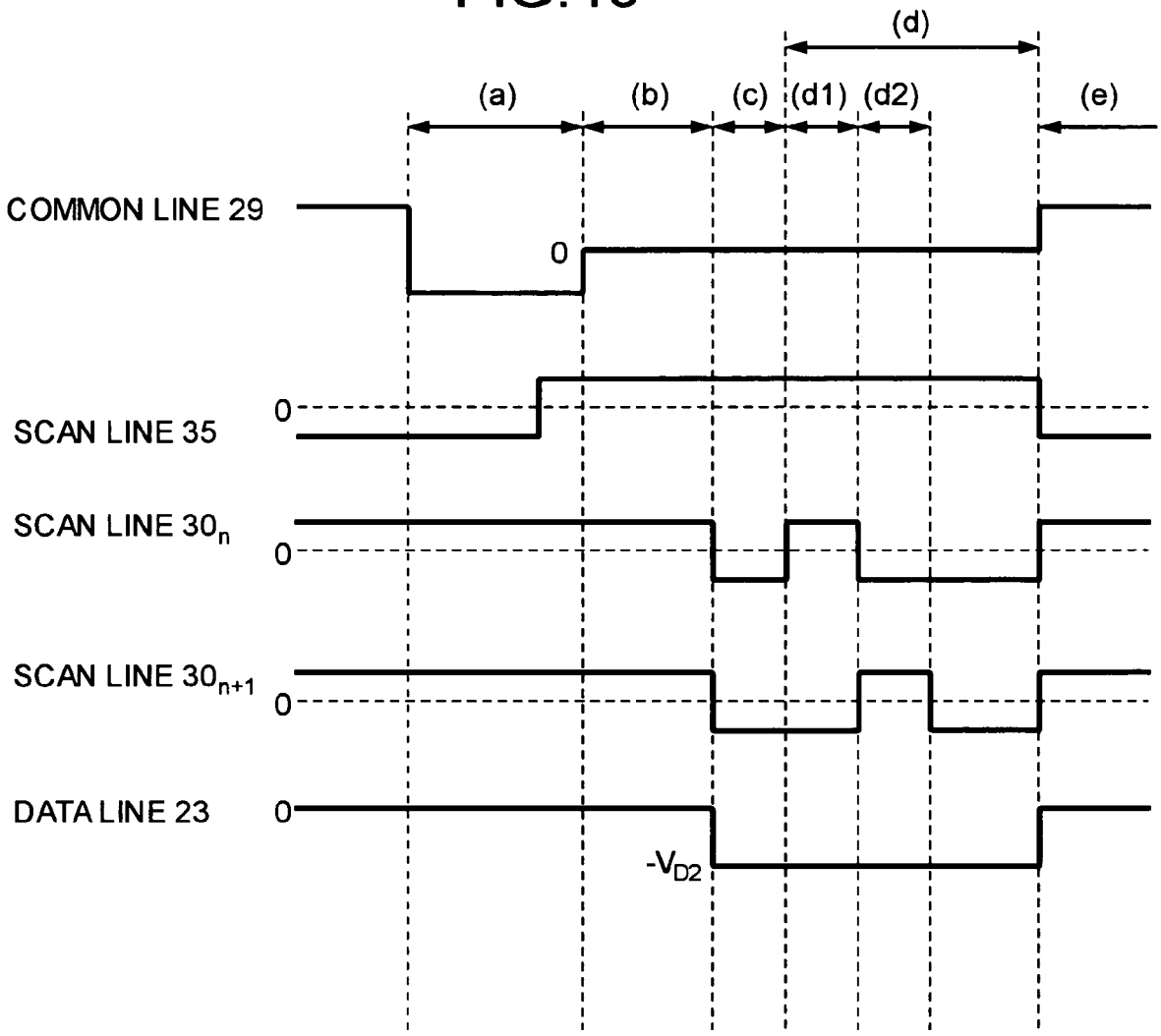
FIG. 15 is a timing chart of the pixel circuit shown in FIG. 14.
Figure 16A:
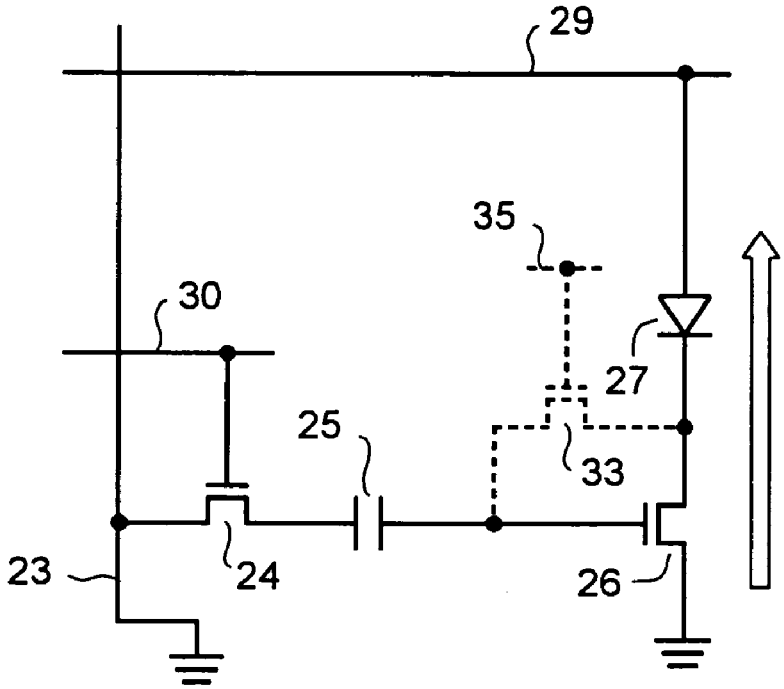
FIG. 16A is a diagram that shows a step of an operating method of the pixel circuit in (a) shown in FIG. 15.
Figure 16B:
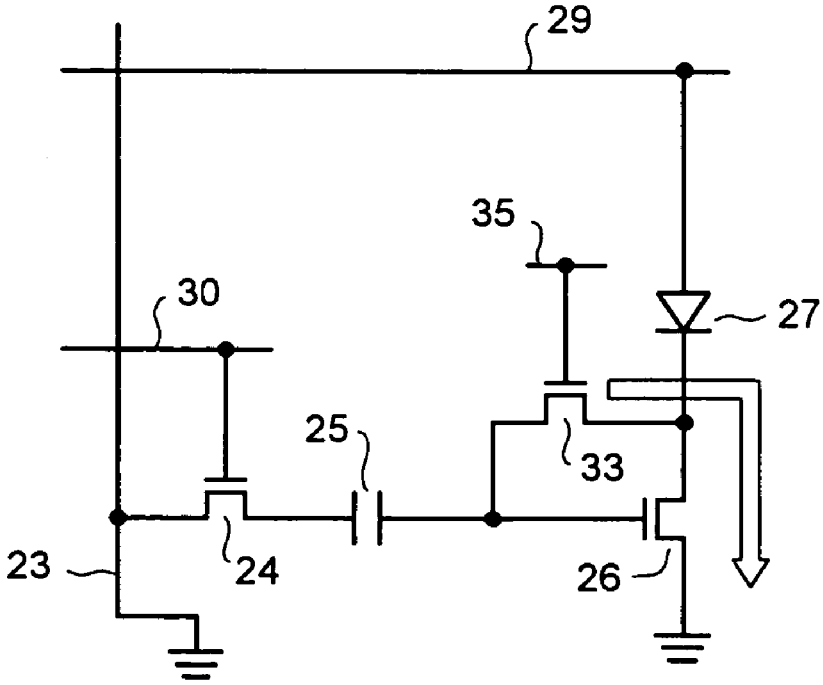
FIG. 16B is a diagram that shows a step of an operating method of the pixel circuit in (b) shown in FIG. 15.
Figure 16C:
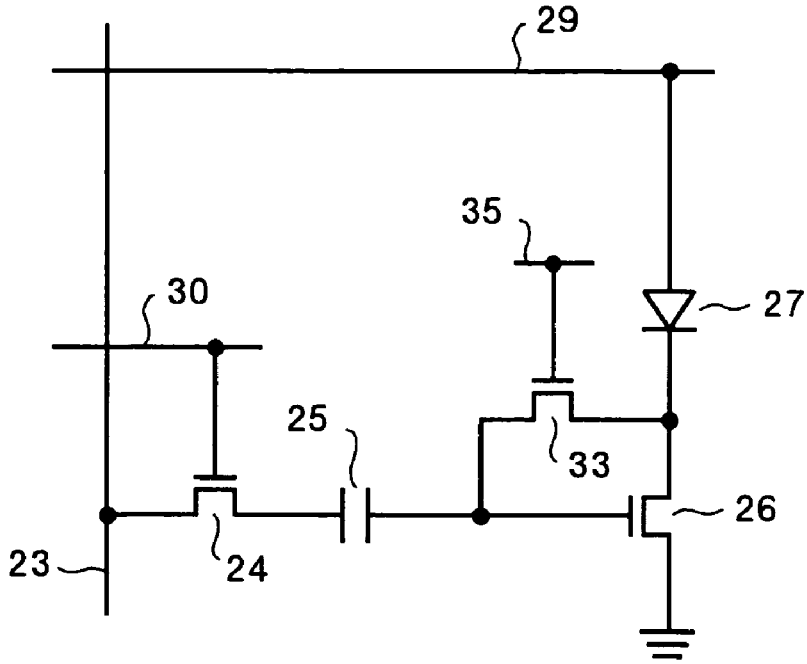
FIG. 16C is a diagram that shows a step of an operating method of the pixel circuit in (c) shown in FIG. 15.
Figure 16D:
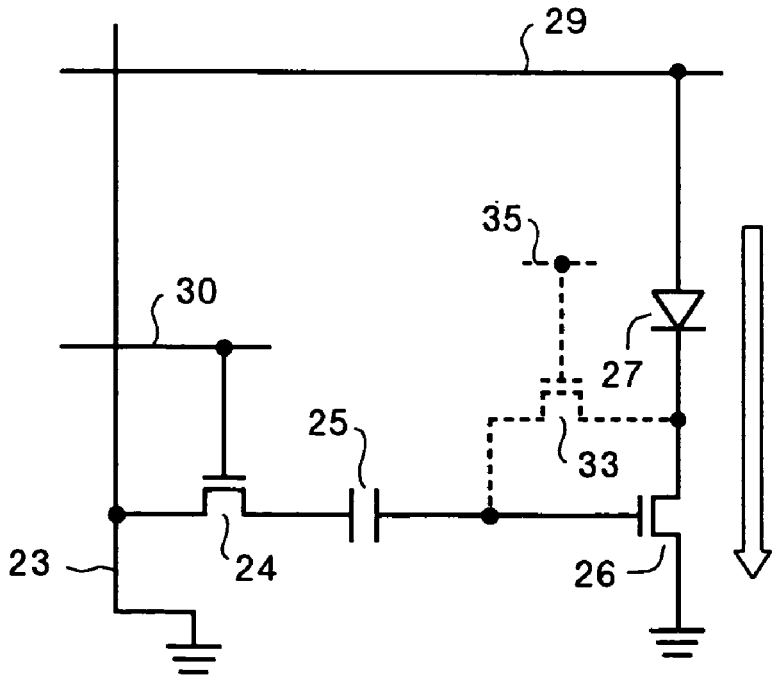
FIG. 16D is a diagram that shows a step of an operating method of the pixel circuit in (d) shown in FIG. 15.

Further, an operation of the pixel circuit shown in FIG. 14 is described by referring to FIG. 15 and FIG. 16A to FIG. 16D. FIG. 15 is a timing chart of the pixel circuit shown in FIG. 14. In FIG. 15, a scan line $\mathbf{30}_n$ in a pixel circuit in the nth row and a scan line $\mathbf{30}_{n+1}$ in a pixel circuit in the n+1th row, are illustrated. FIG. 16A is a diagram that shows a step of an operating method of the pixel circuit in (a) shown in FIG. 15, FIG. 16B is a diagram that shows a step of an operating method of a pixel circuit in (b) shown in FIG. 15, FIG. 16C is a diagram that shows a step of an operating method of the pixel circuit in (d) shown in FIG. 15, FIG. 16D is a diagram that shows a step of an operating method of the pixel circuit in (e) shown in FIG. 15. (a) to (e) of FIG. 15 indicate the pre-processing step, the threshold voltage detection step, the threshold voltage holding step, the data writing step, and the light emitting step respectively similarly as indicated by (a) to (e) of FIG. 12. In FIG. 16A to FIG. 16D, solid lines indicate portions through which current flows and dashed lines indicate portions through which no current flows.

At a pre-processing step shown in (a) of FIG. 15 and FIG. 16A, positive electric charge is allowed to be stored in the cathode side of the organic EL element 27 by allowing negative electric potential by inverting the polarity of the electric potential of the common line 29 from the polarity during the emission of light.

Further, at the threshold voltage detection step shown in (b) of FIG. 15 and FIG. 16B, by putting the TFT 33 ON by allowing positive electric potential in the scan line 35, the gate electrode and the drain electrode of the TFT 26 are shorted and the TFT 26 is put ON. Then, at a point where the voltage between the gate and the source of the TFT 26 is reduced up to the threshold voltage ($=V_{th2}$), the TFT 26 is put OFF and the threshold voltage detection step ends. This threshold voltage detection step maintains the ON state of the TFT 24. For this reason, there is an electric conduction between the data line 23 that supplies zero electric potential and the negative electrode of the capacitor 25 and the threshold voltage can be detected stably. Further, in a display apparatus that uses the pixel circuit shown in FIG. 14, the pre-processing step and the threshold voltage detection step for all the pixel circuits are performed simultaneously.

Further, at the threshold voltage holding step shown in (c) of FIG. 15, the threshold voltage $V_{th2}$ of the TFT 26 which appeared at the gate electrode and the drain electrode of the TFT 26 is held in the positive electrode of the capacitor 25. Here, the threshold voltage holding step is between the end of the threshold voltage detection step and the data writing step and in FIG. 15, for example, a threshold voltage holding step in the nth display apparatus is shown as a period (c).

Further, we move on to the data writing step shown in (d) of FIG. 15 and FIG. 16C. At the data writing step, the data writing step is performed one after another for pixel circuits of all rows or all columns in (d) of FIG. 15 to which the data line 23 supplies electric potential ($-V_{D2}$). For example, in a pixel circuit of the nth row, in ($d_1$) of FIG. 15, by allowing the scan line 30*n* to have positive electric potential and putting a TFT 24*n* ON, the electric potential ($-V_{D2}$) supplied from the data line 23 is held in the negative electrode of the capacitor 25. Further, in a pixel circuit of the (n+1)th row, in ($d_2$) of FIG. 15, by allowing the scan line $\mathbf{30}_{n+1}$ to have positive electric potential and putting a TFT $\mathbf{24}_{n+1}$ ON, the electric potential ($-V_{D2}$) is held in the negative electrode of the capacitor 25. Thus, in (d) shown in FIG. 15, the data writing step is performed one after another for pixel circuits of all rows or columns. And after the data writing step ends, the electric potential applied to the data line 23 becomes zero volts from ($-V_{D2}$).

Further, the light emitting step shown in (e) of FIG. 15 and FIG. 16D is described below. At this step, by allowing the scan line 30 to have positive electric potential and putting the TFT 24 ON, there is an electric conduction between the data line 23 that supplies zero electric potential and the negative electrode of the capacitor 25 and the electric potential of the negative electrode of the capacitor 25 is raised up to zero. Further, the electric potential ($-V_{D2}$) held in the negative electrode is applied to the positive electrode of the capacitor 25 and ($V_{D2}+V_{th}$) appears. Then, the common line 29 is allowed to have positive electric potential, the voltage between the gate and the source of ($V_{D2}+V_{th}$) is generated in the TFT 26, a current corresponding to the voltage between the gate and the source flows in the TFT 26, and the organic EL element 27 displays light of a brightness corresponding to the current flowing. The light emitting step is performed simultaneously for all the pixel circuits, and all the organic EL elements 27 emit light of a predetermined brightness simultaneously, thereby displaying one screen simultaneously.

Thus, the pixel circuit shown in FIG. 14 causes a predetermined reference voltage be supplied to the data line 23 and causes an electrical conductivity between the data line 23 and the negative electrode of the capacitor 25 by putting the TFT 24 ON when the reference voltage is being supplied to the data line 23, thereby enabling to omit the TFT 31 as compared to the pixel circuit shown in FIG. 12. Further, with the omission of the TFT 31, the scan line 34 which is connected to the TFT 31 can also be omitted and the circuit structure can be made simple. For this reason, in the pixel circuit shown in FIG. 14, an area occupied by the TFT, capacitor, and scan line can be reduced. Therefore, it is possible to reduce an area of the pixel circuit and realize a highly defined display apparatus that improves the resolution of image by 1.5 times as compared to the conventional one.

Moreover, since light is displayed simultaneously in all the organic EL elements 27, an image can be displayed without being affected by the previous frame. Conventionally, for example when the nth pixel circuit performs the data writing step, the m-th pixel circuit that has already ended the data writing step performs the light emitting step. Due to this, in a conventional display apparatus, there is an area for displaying information of the previous frame while displaying an image. Therefore, in the conventional display apparatus, sometimes images which should be displayed at different times are displayed simultaneously and it is not suitable for displaying video images. However, in a case of the display circuit that includes the pixel circuit shown in FIG. 14, since all the organic EL elements 27 display light simultaneously, the problem mentioned above does not arise and it is possible to display video images accurately and improve video characteristics.

Further, in the pixel circuit in FIG. 14, although the description is made with zero electric potential as the predetermined reference voltage, it is not limited to zero electric potential and any constant electric potential of a value higher than the electric potential ($-V_{D2}$) corresponding to the brightness of emitted light from the organic EL element 27 may be used. This is because, when an electric potential of a value lower than the electric potential ($-V_{D2}$) is applied as the reference electric potential to the data line 23 at the threshold voltage detection step, the voltage between the gate and the source of the TFT 26 becomes less that the threshold voltage due to which the TFT 26 is not put ON at the threshold voltage detection step and the threshold voltage of the TFT 26 cannot be detected. Moreover, when the reference voltage is not zero electric potential, in order to cause to display light of a brightness set in the organic EL element 27, at the data writing step, it is necessary to take into consideration the difference between the reference electric potential and an electric potential corresponding to the brightness of light emission of the organic EL element 27 and set the electric potential which the data line 23 supplies.

Further, in FIG. 15, at the data writing step, although a case of where the data line 23 supplies the electric potential ($-V_{D2}$) is indicated, the data line 23 supplies any electric potential between zero electric potential and the electric potential ($-V_{D2}$) according to the brightness set for the organic EL element 27 of each pixel circuit for each pixel.

Further, a display apparatus according to a third embodiment is described. The display apparatus according to the third embodiment has a data writing section that includes a data line, a first switching section, and a capacitor and writes an electric potential corresponding to a brightness of light emitted and a threshold voltage detecting section that includes a current light emitting element, and two TFTs as a second switching section and detects a threshold voltage of a driver element. According to this display apparatus, the structure is such that the data writing section and the threshold voltage detecting section operate independently and an electric potential in which a threshold voltage that is detected by the threshold voltage detecting section that functions independently from the data writing section is added to an electric potential that is written by the data writing section, is applied to the driver element so that even in a case of fluctuations in the threshold voltage of the driver element, a display apparatus that supplies a uniform current to the current light emitting element is realized.

Figure 17:
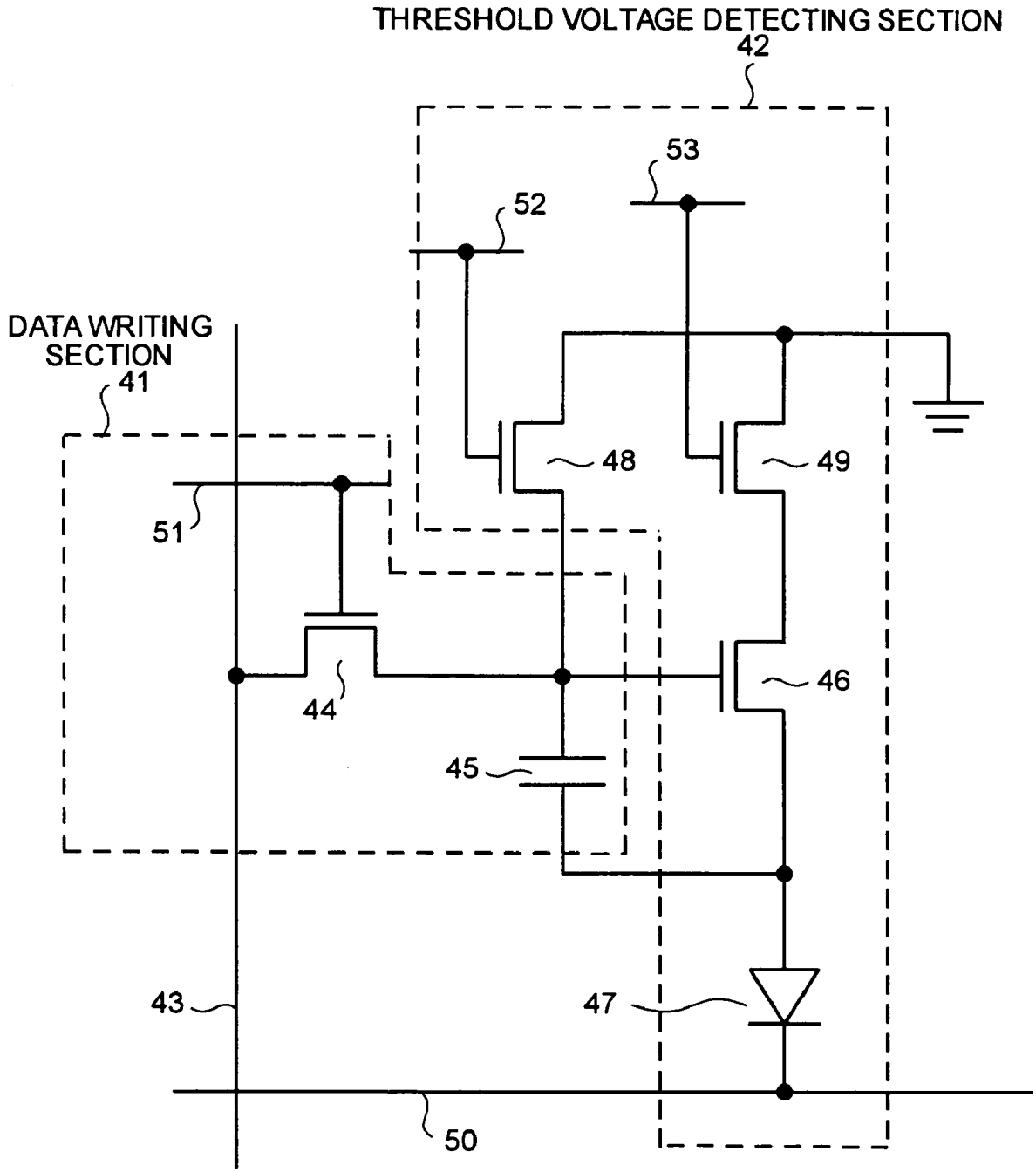
FIG. 17 is a diagram in which a structure of a pixel circuit in a third embodiment is shown.

FIG. 17 is a diagram in which a structure of a pixel circuit in the third embodiment is shown. The pixel circuit in the third embodiment, as shown in FIG. 17 is equipped with a data writing section 41 that includes a data line 43 which supplies an electric potential corresponding to a brightness of the current light emitting element, a TFT 44 which is a first switching section, a capacitor 45 that holds electric potential which is written, and a scan line 51 that is a first scan line which is connected to a gate electrode of the TFT 44. The data writing section 41 functions as an example of a data writing section in the claims. The TFT 44 functions as an example of a first switching section in the claims. The capacitor 45 has a function of holding an electric potential that is supplied from the data line 43. The scan line 51 functions as an example of a first scan line in the claims.

Moreover, the pixel circuit in the third embodiment is equipped with a threshold voltage detecting section 42 that includes a TFT 4 which is a driver element, a second switching section that includes a TFT 48 which is a first thin film transistor and a TFT 49 which is a second thin film transistor, an organic EL element 47 which is a current light emitting element, and a common line 50 which is a power-supply line connected to the organic EL element 47. To facilitate the description, regarding a TFT 46, an electrode that is connected to the organic EL element 47 is let to be a source electrode and an electrode that is connected to the TFT 49 is let to be a drain electrode. The threshold voltage detecting section 42 functions as an example of a threshold voltage detecting section in the claims. The TFT 46 functions as an example of a driver element in the claims and has a function of controlling a current according to an electric potential written by the data writing section 41. The organic EL element 47 functions as an example of a current light emitting element in the claims. The TFT 48 functions as an example of a first thin film transistor in the claims and the TFT 49 functions as an example of a second thin film transistor in the claims. Further, the common line 50 functions as an example of a power-supply line in the claims.

The data writing section 41 is applied with an electric potential corresponding to a display brightness of the organic EL element 47 by the data line 43 and has a function of holding this electric potential. The data line 43, the TFT 44 which is the first switching section, the capacitor 45, and the scan line 51 which is the first scan line in the data writing section 41 have functions similar to the components of the data writing section of the pixel circuit in the first embodiment.

The threshold voltage detecting section 42 has a function of detecting threshold voltage of the TFT 46 which is the driver element. The TFT 46, which is the driver element in the threshold voltage detecting section 42 has a function of supplying to the organic EL element 47 a current corresponding to the voltage between the gate and the source when the TFT 46 is put ON. Further, although the organic EL element 47 which is connected to the source electrode of the TFT 46 is primarily for displaying light of brightness corresponding to current that is applied when the TFT 46 is ON, it functions as a capacitor that supplies electric charge to the source electrode of the TFT 46 in the threshold voltage detecting section 42.

The TFT 48 and the TFT 49 form a second switching section. a source electrode of the TFT 48 is connected to a gate electrode of the TFT 46, a source electrode of the TFT 49 is connected to the drain electrode of the TFT 46, and a drain electrode of the TFT 49 and a drain electrode of the TFT 48 are connected to each other as well as to ground. In other words, by putting both the TFT 48 and the TFT 49 ON, the gate electrode and the drain electrode of the TFT 46 are shorted and connected to ground. As mentioned in the latter part, in the display apparatus according to the third embodiment, by providing the TFT 48 and the TFT 49, it is possible to detect the threshold voltage of the TFT 46 without using components like the data line 43 of the data writing section 41. Further, the TFT 49 has a function of holding the detected threshold voltage of the TFT 46 in the source electrode of the TFT 46 when it is put OFF. The TFT 48 is controlled by a scan line 52 and the TFT 49 is controlled by a scan line 53. Moreover, the common line 50 which is the power-supply line, has a function similar to the common line 9 in the pixel circuit in the first embodiment.

Figure 18:
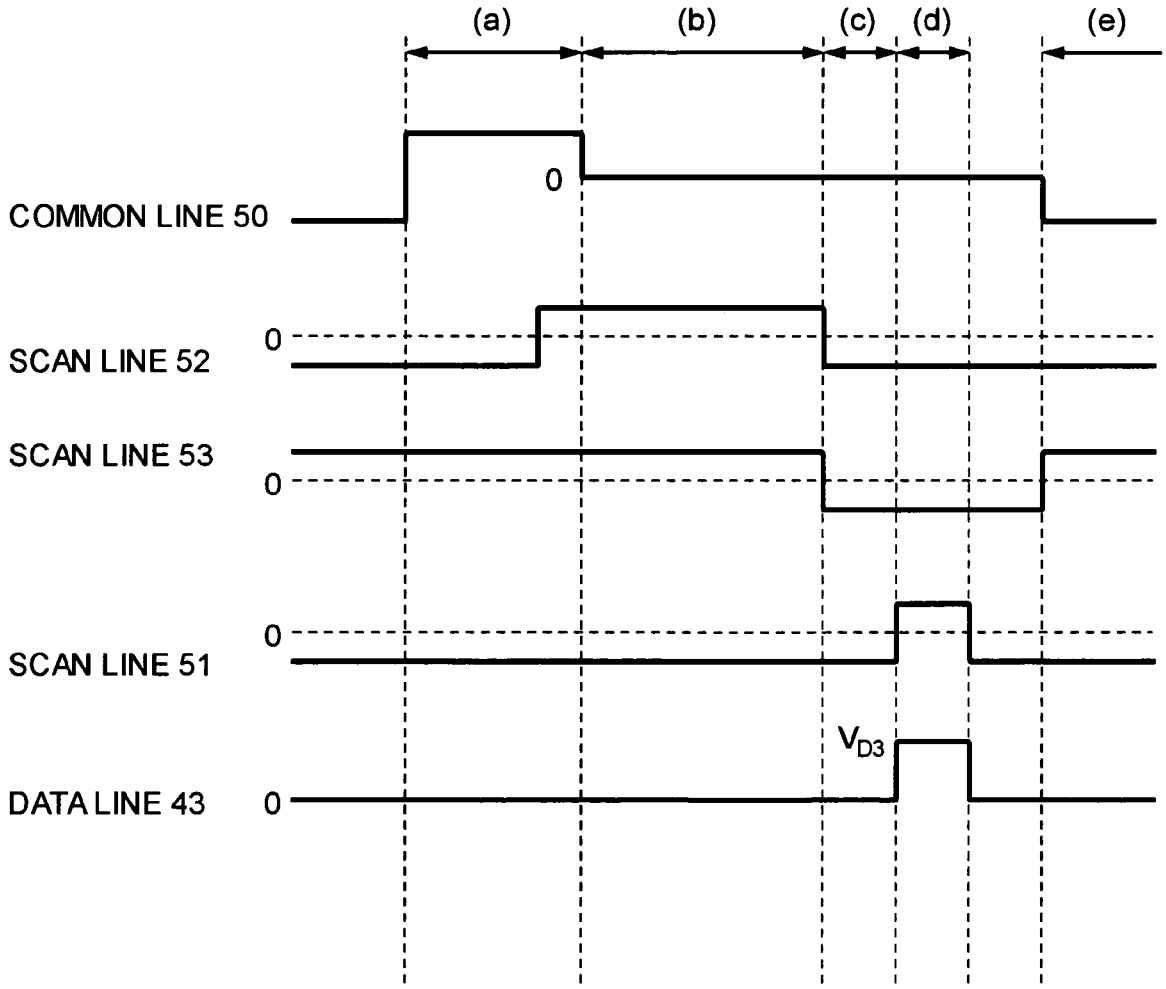
FIG. 18 is a timing chart of the pixel circuit shown in FIG. 17.

Further, an operation of the pixel circuit in the third embodiment shown in FIG. 17 is described by referring to FIG. 18 and FIG. 19. FIG. 18 is a timing chart of the pixel circuit in the third embodiment. FIG. 19A is a diagram that shows a step of an operating method of the pixel circuit in (a) shown in FIG. 18, FIG. 19B is a diagram that shows a step of an operating method of the pixel circuit in (b) shown in FIG. 18, FIG. 19C is a diagram that shows a step of an operating method of the pixel circuit in (c) shown in FIG. 18, FIG. 19D is a diagram that shows a step of an operating method of the pixel circuit in (d) shown in FIG. 18, and FIG. 19E is a diagram that shows the pixel circuit in (e) shown in FIG. 18. As shown in (a) to (e) of FIG. 18 and FIG. 19A to 19E, in the pixel circuit, the data writing and the threshold voltage detection are performed by independent steps. In FIG. 19A to FIG. 19E, solid lines indicate portions through which current flows and dashed lines indicate portions through which no current flows.

Figure 19A:
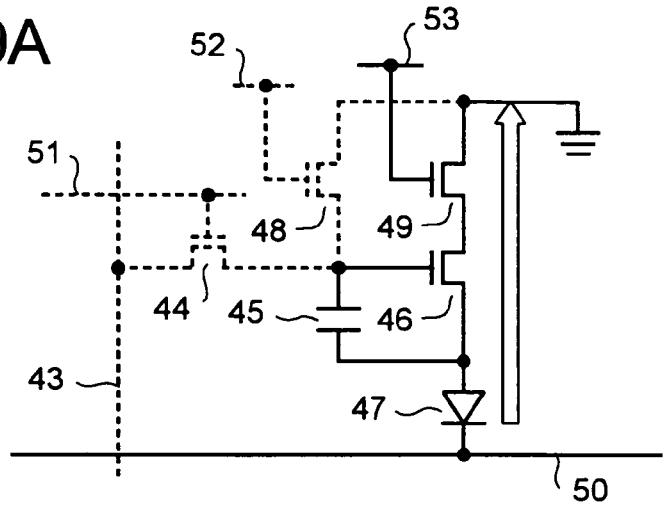
FIG. 19A is a diagram that shows a step of an operating method of the pixel circuit in (a) shown in FIG. 18.

A step shown in (a) of FIG. 18 and FIG. 19A is a pre-processing step of storing electric charge in the organic EL element 47 as the previous step of the threshold voltage detection. Concretely, it is a step of storing electric charge in the organic element EL 47 by allowing a current flow in the TFT 46 in a direction opposite to that during the emission of light. At this step, similarly as at the pre-processing step of the pixel circuit in the first embodiment, the negative electric charge which is sufficiently greater than an electric charge that is remained in the capacitor 45 is stored in the anode side due to inverting the polarity of the electric potential of the common line 50 compared to that during the emission of light. Further, to connect the drain electrode of the TFT 46 to ground, the TFT 49 maintains ON state. After the electric charge is stored in the organic EL element 47, the scan line 52 is let to have positive electric potential and the TFT 48 is put ON to hold the stored electric charge stored.

Figure 19B:
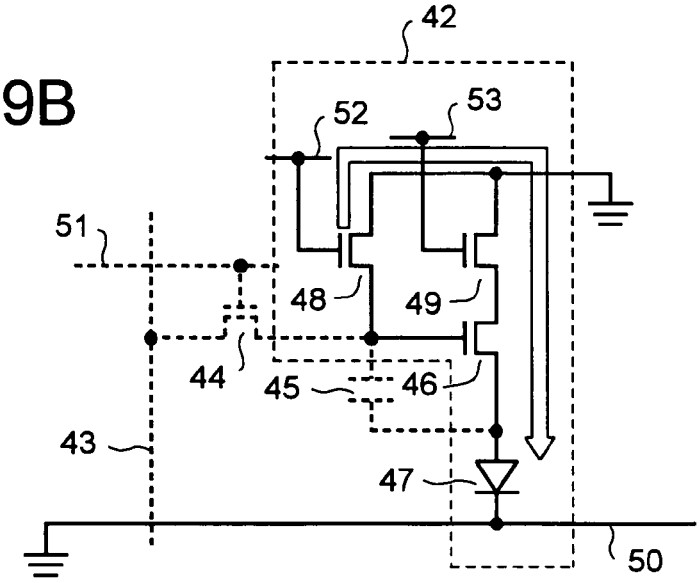
FIG. 19B is a diagram that shows a step of an operating method of the pixel circuit in (b) shown in FIG. 18.

A step shown in (b) of FIG. 18 and FIG. 19B is a threshold voltage detection step of detecting the threshold voltage of the TFT 46 which is the driver element, by the threshold voltage detecting section 42. After the end of accumulation of the positive electric charge in the organic EL element 47 at the pre-processing step, the common line 50 becomes zero potential from the positive electric potential. Since the scan line 52 and the scan line 53 are both with the positive electric potential as they are, by maintaining the ON state of the TFT 48 and the TFT 49, the gate electrode and the drain electrode of the TFT 46 are shorted, and the TFT 46 is connected to ground. Therefore, zero electric potential is applied to the gate electrode and the drain electrode of the TFT 46. Here, since the organic EL element 47 is connected to the source electrode of the TFT 46, based on the negative electric charge stored in the anode side of the organic EL element 47, the voltage between the gate and the source of the TFT 46 becomes greater than the threshold voltage and the TFT 46 is put ON. The drain electrode of the TFT 46 is connected to ground through the TET 49 which is ON, whereas the source electrode of the TFT 46 is connected to the organic EL element 47 in which the negative charge is stored and negative electric potential is applied to the source electrode. Therefore, the electric potential difference is developed between the gate electrode and the source electrode of the TFT 46 and the current flows from the drain electrode to the source electrode. Due to the current flow, an absolute value of the negative charge that was stored in the organic EL element 47 decreases gradually and at a point where the voltage between the gate and the source of the TFT 46 is reduced up to the threshold voltage ($=V_{th3}$), the TFT 46 is put OFF and the negative charge stored in the organic EL element 47 stops decreasing. Since the gate electrode of the TFT 46 is connected to ground through the TFT 49 which is ON, an electric potential of the source electrode of the TFT 46 is held at ($-V_{th3}$). Due to this, the threshold voltage ($-V_{th3}$) of the TFT 46 appears at the source electrode of the TFT 46 and the threshold voltage of the TFT 46 is detected. Further, at this step, the detection of the threshold voltage of the TFT 46 is performed by components of the threshold voltage detecting section 42 only and an operation of components of the data writing section 41 is not necessary.

Figure 19C:
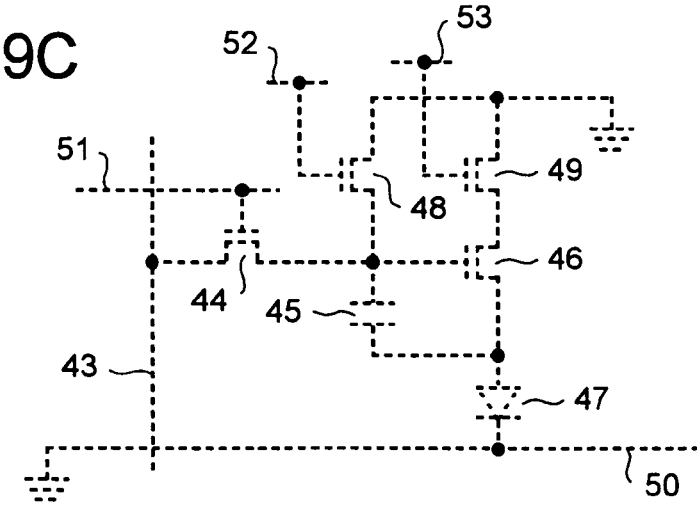
FIG. 19C is a diagram that shows a step of an operating method of the pixel circuit in (c) shown in FIG. 18.

(c) of FIG. 18 and FIG. 19C are a threshold voltage holding step of holding the threshold voltage detected, of the TFT 46. To put both the TFT 48 and the TFT 49 OFF, the scan line 52 and the scan line 53 are let to have negative electric potential. Since the TFT 49 is put OFF, the threshold voltage ($-V_{th3}$) of the TFT 46 appeared at the source electrode of the TFT 46 is held stably without being discharged to ground.

Figure 19D:
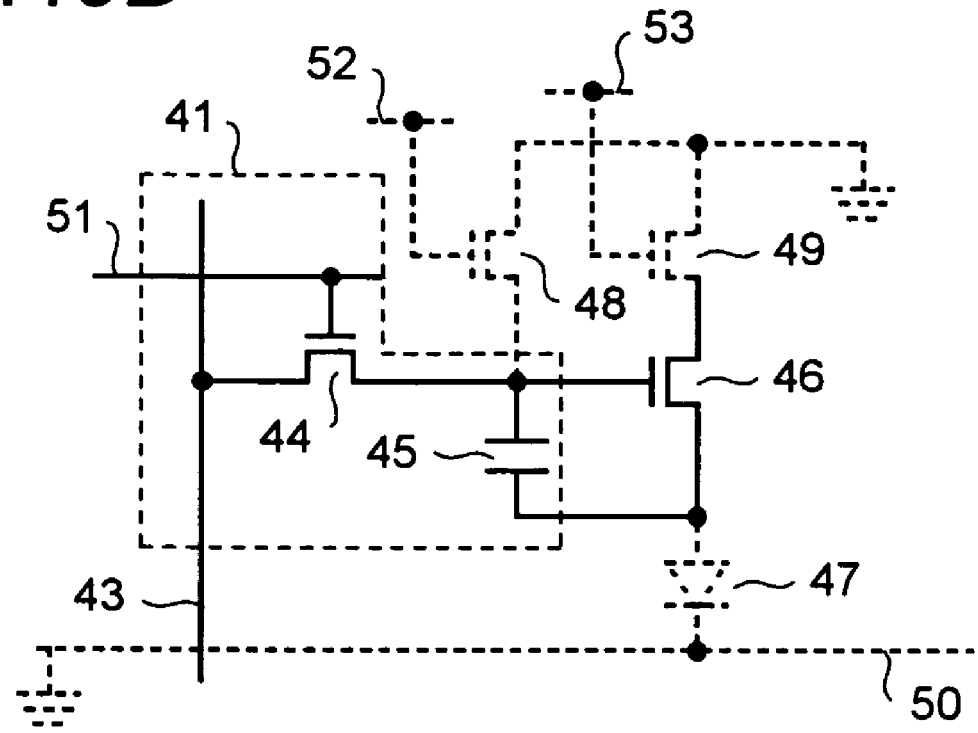
FIG. 19D is a diagram that shows a step of an operating method of the pixel circuit in (d) shown in FIG. 18.

A step shown in (d) of FIG. 18 and FIG. 19D are a data writing step. Similarly as in the data writing step of the pixel circuit in the first embodiment, an electric potential corresponding to a brightness of the organic EL element 47 is written from the data line 43 through the TFT 44 and is held in the capacitor 45. Further, the electric potential written at this step is $V_{D3}$. Here, the data writing is performed by the components of the data writing section 41 only, and an operation of the threshold voltage detecting section 42 is not necessary. In other words, since the data writing is performed by the components of the data writing section 41 only, and the detection of the threshold voltage is performed by the components of the threshold voltage detecting section 42 only, the data writing section 41 and the threshold voltage detecting section 42 function independently. Further, at this step due to the structure of the pixel circuit, although $V_{D3}$ which is a writing electric potential, is applied to the gate electrode of the TFT 46 and the TFT 46 is put ON, since the TFT 49 which is connected to the drain electrode of the TFT 46 is OFF, no current flows through the TFT 46 and the threshold voltage of the TFT 46 which is detected at the threshold voltage detection step does not disappear.

Figure 19E:
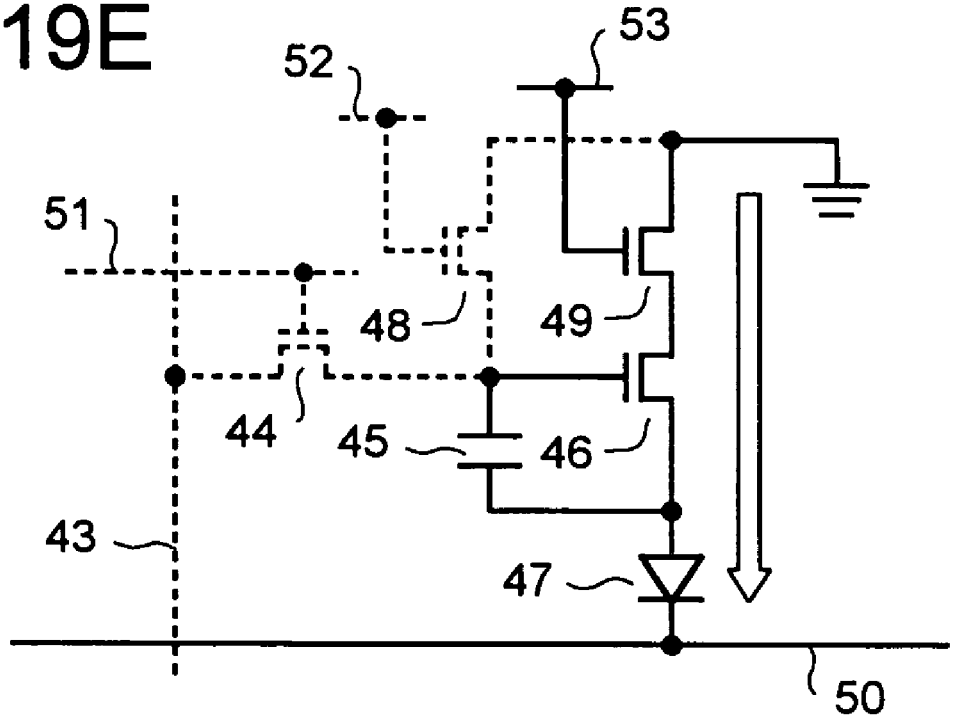
FIG. 19E is a diagram that shows a step of an operating method of the pixel circuit in (e) shown in FIG. 18.
Figure 20:
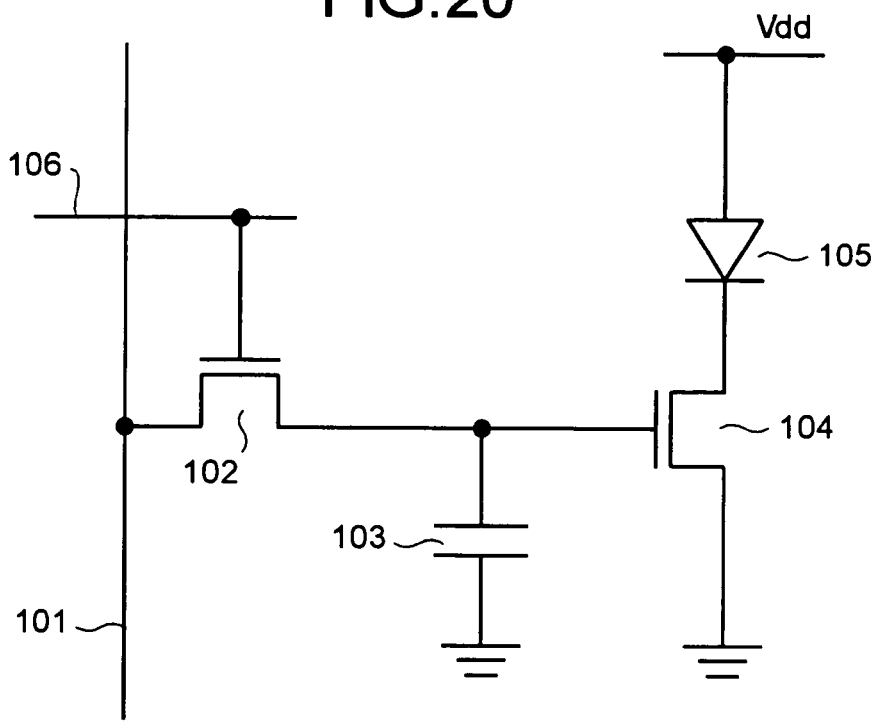
FIG. 20 is a pixel circuit in an organic EL display apparatus of an active matrix type according to a conventional technology.
Figure 21:
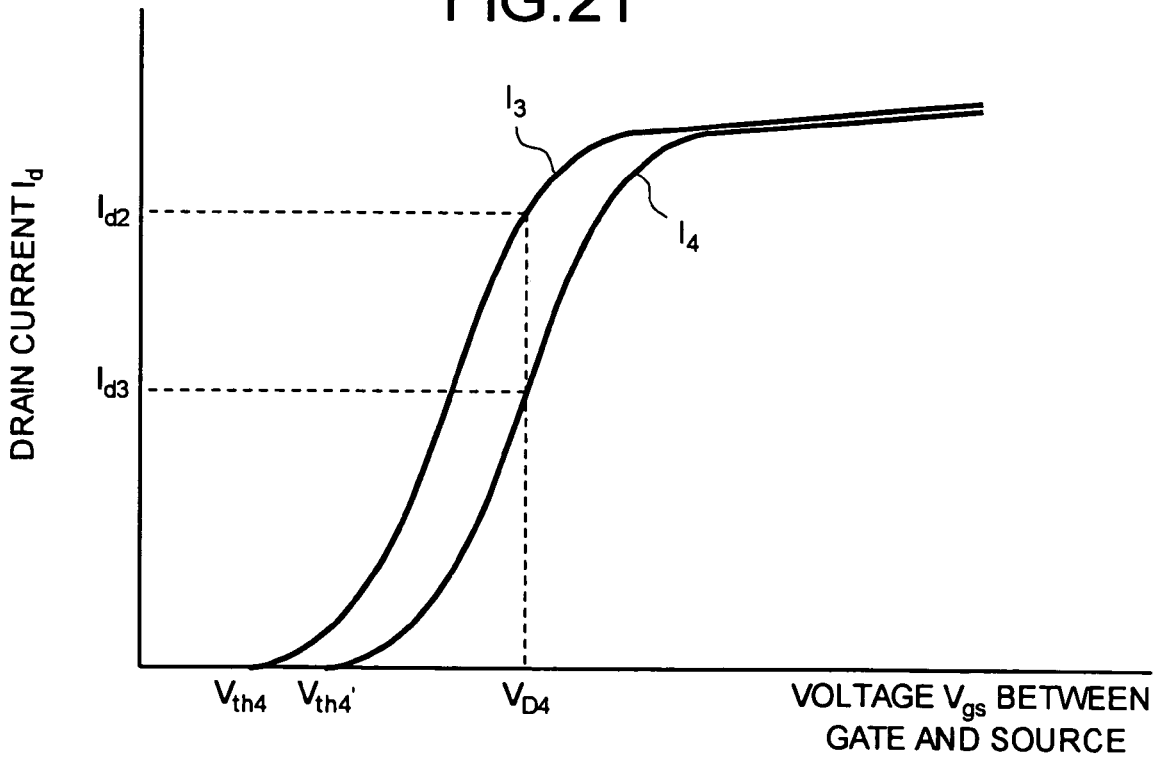
FIG. 21 is a graph that shows voltage-current characteristics of a TFT before deterioration and the TFT after deterioration.

A step shown in (e) of FIG. 18 and FIG. 19E is a light-emitting step of emitting light by the organic EL element 47. In other words, it is a process in which the electric charge held in the capacitor 45 is supplied to the TFT 46 which is the driver element, the TFT 46 is put ON, and due to flowing of current in the TFT 46, the organic EL element 47 emits light. Here, the electric potential $V_{D3}$ is applied to the gate electrode of the TFT 46 from the capacitor 45 which is connected to the gate electrode of the TFT 46. As a result of this, the gate electrode of the TFT 46 is put ON. Here, the threshold voltage ($-V_{th3}$) detected at the threshold voltage detection step appears at the source electrode of the TFT 46. Moreover, at this step, due to the electric potential $V_{D3}$ applied by the capacitor 45 to the gate electrode of the TFT 46, the voltage ($V_{D3}+V_{th3}$) between the gate and the source is generated in the TFT 46. As a result of this, a current corresponding to the voltage between the gate and the source flows through the TFT 46. Due to the current flow through the TFT 46 which is the driver element, the current also flows through the organic EL element 47 that is connected to the TFT 46, and the organic EL element 47 displays light of a brightness corresponding to the current flowing through it. Further, to prevent elimination of the electric charge that is supplied from the capacitor due to discharge of the electric charge, it is necessary to put OFF the TFT 48 which is connected to the capacitor 45. For this, the scan line 52 is at negative electric potential as it is. Moreover, because of connecting the drain electrode of the TFT 46 to ground, the scan line 53 is at positive electric potential and the TFT 49 is put ON. Further, at this step, since the electric potential is not written from the data line 43, the scan line 52 is at negative potential as it is, because it is necessary to put the TFT 44 OFF.

In the display apparatus according to the third embodiment, similarly as in the display apparatus according to the first embodiment, the voltage between the gate and the source of the TFT 46 which is the driver element at the light-emitting step, is a sum of the electric potential $V_{D3}$ that is written and the threshold voltage of the TFT 46 $V_{th3}$, and a current corresponding to the sum of the voltages flows through the TFT 46. Therefore, since the voltage in which the threshold voltage of the TFT 46 is added to the electric potential written $V_{D3}$ becomes the voltage between the gate and the source of the TFT 46 even when the threshold voltage fluctuates, the fluctuation in the threshold voltage of the TFT 46 is compensated. As a result of this, the current flowing through the TFT 46 does not fluctuate even when the threshold voltage of the TFT 46 which is the driver element, fluctuates, and the organic EL element 47 displays light of uniform brightness, thereby suppressing the deterioration of the image quality.

Moreover, in the display apparatus according to the third embodiment, by providing the TFT 48 and the TFT 49 as the second switching section, at the threshold voltage detection step, the gate electrode and the drain electrode of the TFT 46 are caused to be shorted and the gate electrode and the drain electrode of the TFT 46 are connected to ground. As a result of this, in the TFT 46, the potential difference is developed between the gate electrode and the source electrode that is connected to the organic EL element 47 and in which the negative electric charge is stored and through which the current flows. After this, the voltage between the gate and the source becomes the threshold voltage ($V_{th3}$) and due to the TFT 46 being put OFF, the threshold voltage is detected in the source electrode. Therefore, by providing the TFT 48 and the TFT 49, the threshold voltage is detected by an operation of the components of the threshold voltage detecting section 42 only. Therefore, at the threshold voltage step, it is not necessary to make zero the electric potential of the data line 43 that is connected to the gate electrode of the TFT 46 through the TFT 44 and the operation of the components of the data writing section 41 is not necessary for the detection of the threshold voltage.

Moreover, in the pixel circuit in the third embodiment, the positive electrode of the capacitor 45 is connected directly to the gate electrode of the TFT 46 which is the driver element. Therefore, since the electric potential that is supplied by the data line 43 and held in the capacitor 45, is applied directly to the gate electrode of the TFT 46, the data written is highly reliable.

Further, in the third embodiment, apart from displaying an image by a method in which the data writing step is performed for each row or column and the light emitting step is performed one after another for each row or column, the image may be displayed by an overall collective control method of displaying one screen simultaneously by allowing all the organic EL elements 47 to emit light simultaneously. Further, in the third embodiment, the pre-processing step may be performed simultaneously for all the pixel circuits. In other words, the electric charge may be allowed to be stored in all the organic EL elements 47 simultaneously. Moreover, in the third embodiment, the threshold voltage detection step may be performed simultaneously for all the pixel circuits. In other words, all the TFTs 48 are put ON simultaneously and the drain electrode and the gate electrode of the TFT 46 may be shorted.

What is claimed is:

1. A display apparatus comprising:

a data writing section that includes a data line and a first switching section which controls writing of electric potential that is supplied through the data line, and writes an electric potential corresponding to an emission brightness; and a threshold voltage detecting section that includes a driver transistor which controls current according to the electric potential written by the data writing section;

a second switching section which controls conduction between a gate electrode and a drain electrode of the driver transistor; and a current-controlled light emitting element that emits light with a brightness corresponding to a current flowing therethrough, and functions as a capacitor for supplying electric charge to the drain electrode or a source electrode of the driver transistor, wherein the threshold voltage detecting section detects a threshold voltage of the driver transistor.

2. The display apparatus according to claim 1, wherein the threshold voltage detecting section detects the threshold voltage by OFF state in which a potential difference between the gate and source electrodes of the driver transistor whose gate electrode and drain electrode are shorted by the second switching section drops to the threshold voltage by a reduction in the electric charge stored in the current-controlled light emitting element after the driver transistor is put ON based on a potential difference between the gate and the source electrodes caused by the electric charge stored.

3. The display apparatus according to claim 1, wherein an electric potential applied to the driver transistor during emission of light is a sum of the threshold voltage detected by the threshold voltage detecting section and the electric potential written by the data writing section.

4. The display apparatus according to claim 1, wherein the threshold voltage detecting section includes a power-supply line that supplies current by applying voltage in a forward direction to the current-controlled light emitting element during emission of light, and that stores electric charge in the current light emitting element by applying voltage in a reverse direction to the current-controlled light emitting element.

5. The display apparatus according to claim 1, further comprising a first scan line for controlling a drive state of the first switching section.

6. The display apparatus according to claim 1, wherein the current-controlled light emitting element is an organic electroluminescence element.

7. The display apparatus according to claim 1, wherein the data writing section further includes a capacitor which holds an electric potential supplied from the data line.

8. The display apparatus according to claim 1, further comprising a third switching section that is provided between the data writing section and the threshold voltage detecting section, and controls electric conduction between the data writing section and the threshold voltage detecting section.

9. The display apparatus according to claim 8, further comprising a second scan line for controlling a drive state of the second switching section and a drive state of the third switching section, wherein the second switching section includes a first transistor whose gate electrode is connected to the second scan line and which has a first channel layer with a first conductivity type, and the third switching section includes a second transistor whose gate electrode is connected to the second scan line and which has a second channel layer with a second conductivity type opposite to the first conductivity type.

10. The display apparatus according to claim 8, wherein each of the second switching section and the third switching section has a transistor with a same conductivity type of channel layer, and the drive state of the second switching section and the drive state of the third switching section are controlled through different scan lines.

11. The display apparatus according to claim 1, further comprising:

a capacitor that is disposed between the data writing section and the threshold voltage detecting section and includes a first electrode electrically connected to the data writing section and a second electrode electrically connected to the threshold voltage detecting section; and a fourth switching section that is electrically connected to the first electrode and controls electric potential of the first electrode.

12. The display apparatus according to claim 11, wherein the fourth switching section, when in ON state, while maintaining an electric potential difference between the first electrode and the second electrode, causes a same amount and different polarity of an electric charge as that held in the first electrode to the second electrode and eliminates an electric charge held in the first electrode, and when in OFF state, continues to hold the electric charge without transferring the electric charge held in the capacitor.

13. The display apparatus according to claim 11, further comprising a third scan line for controlling a drive state of the second switching section and a drive state of the fourth switching section, wherein the second switching section includes a first transistor whose gate electrode is connected to the third scan line and which has a first channel layer with a first conductivity type, and the fourth switching section includes a second transistor whose gate electrode is connected to the third scan line and which has a second channel layer with a second conductivity type opposite to the first conductivity type.

14. The display apparatus according to claim 11, wherein each of the second switching section and the fourth switching section has a transistor with a same conductivity type of channel layer, and the drive state of the second switching section and the drive state of the fourth switching section are controlled through different scan lines.

15. The display apparatus according to claim 1, wherein the second switching section includes a first transistor connected to a gate electrode of the driver transistor and a second thin film transistor connected to the drain electrode of the transistor.

16. The display apparatus according to claim 15, wherein the threshold voltage detecting section detects the threshold voltage by OFF state in which a potential difference between the gate and source electrodes of the driver transistor whose gate electrode and drain electrode are shorted by the first and second transistors which are in ON state drops to the threshold voltage by a reduction in the electric charge stored in the current-controlled light emitting element after the driver transistor is put ON based on a potential difference between the gate and the source electrodes caused by the electric charge stored, and the second transistor holds the threshold voltage detected.

17. The display apparatus according to claim 1, further comprising a capacitor that is disposed between the data writing section and the threshold voltage detecting section and includes a first electrode electrically connected to the data writing section and a second electrode electrically connected to the threshold voltage detecting section, wherein the data line supplies a reference electric potential during the emission, during detection of the threshold voltage, and during storing of the electric charge in the current-controlled light emitting element, and the first switching section causes electric conduction between the data line and the first electrode during the emission, during the detection, and during the storing.

18. A display apparatus comprising a plurality of pixel circuits, each of the pixel circuits including a data writing section that includes a data line and a first switching section which controls writing of electric potential that is supplied through the data line, and writes an electric potential corresponding to an emission brightness; and a threshold voltage detecting section that includes a driver transistor which controls current according to the electric potential written by the data writing section;

a second switching section which controls conduction between a gate electrode and a drain electrode of the driver transistor; and a current-controlled light emitting element that emits light with a brightness corresponding to a current flowing therethrough, and functions as a capacitor for supplying electric charge to the drain electrode or a source electrode of the driver transistor, wherein the threshold voltage detecting section detects a threshold voltage of the driver transistor, and the current-controlled light emitting element emits to display one screen simultaneously among all the pixel circuits.

19. A display apparatus comprising a plurality of pixel circuits, each of the pixel circuits including a data writing section that includes a data line and a first switching section which controls writing of electric potential that is supplied through the data line, and writes an electric potential corresponding to an emission brightness; and a threshold voltage detecting section that includes a driver transistor which controls current according to the electric potential written by the data writing section;

a second switching section which controls conduction between a gate electrode and a drain electrode of the driver transistor; and a current-controlled light emitting element that emits light with a brightness corresponding to a current flowing therethrough, and functions as a capacitor for supplying electric charge to the drain electrode or a source electrode of the driver transistor, wherein the threshold voltage detecting section detects a threshold voltage of the driver transistor, the electric charge is stored in the current-controlled light emitting element simultaneously among all the pixel circuits, and the second switching section shorts the gate electrode and the drain electrode of the driver transistor simultaneously among all the pixel circuits.

* * * * *